US011903442B2

(12) United States Patent
Frank et al.

(10) Patent No.: US 11,903,442 B2
(45) **Date of Patent: *Feb. 20, 2024**

(54) SOLE STRUCTURE FOR ARTICLE OF FOOTWEAR

(71) Applicant: NIKE, Inc., Beaverton, OR (US)

(72) Inventors: Nick S Frank, Portland, OR (US); Dolores S. Thompson, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/061,559

(22) Filed: Dec. 5, 2022

(65) Prior Publication Data

US 2023/0098712 A1 Mar. 30, 2023

Related U.S. Application Data

(63) Continuation of application No. 17/378,477, filed on Jul. 16, 2021, now Pat. No. 11,528,960, which is a (Continued)

(51) Int. Cl.
*A43B 13/20* (2006.01)
*A43B 13/04* (2006.01)

(Continued)

(52) U.S. Cl.
CPC ..... *A43B 13/20* (2013.01); *A43B 13/04* (2013.01); *A43B 13/125* (2013.01); *A43B 13/186* (2013.01); *A43B 13/187* (2013.01)

(58) Field of Classification Search
CPC ..... A43B 13/18; A43B 13/189; A43B 13/20; A43B 13/186; A43B 13/188

(Continued)

(56) References Cited

U.S. PATENT DOCUMENTS 4,768,295 A 9/1988 Ito
4,817,304 A 4/1989 Parker et al.

(Continued)

FOREIGN PATENT DOCUMENTS

CN 1064395 A 9/1992
CN 101296630 A 10/2008

(Continued)

OTHER PUBLICATIONS

European Patent Office as ISA, International Search Report and Written Opinion for PCT Application No. PCT/US2019/044150, dated Nov. 8, 2019.

(Continued)

*Primary Examiner* — Marie D Bays
(74) *Attorney, Agent, or Firm* — Honigman LLP; Matthew H. Szalach; Jonathan P. O'Brien

(57) ABSTRACT

A sole structure for an article of footwear includes a foam element having a top surface and a bottom surface. The foam element includes a recess (i) formed in one of the top surface or the bottom surface, (ii) extending from a first end in a forefoot region of the sole structure to a second end in a mid-foot region of the sole structure, (iii) having a first edge extending between the first end and the second end and disposed proximate to a peripheral region of the sole structure, and (iv) a second edge extending between the first end and the second end and disposed at an interior region of the sole structure. A cushioning arrangement is disposed within the recess and includes an outer surface that is substantially flush with the one of the top surface or the bottom surface of the foam element.

20 Claims, 20 Drawing Sheets

Related U.S. Application Data continuation of application No. 16/525,974, filed on Jul. 30, 2019, now Pat. No. 11,071,349.

(60) Provisional application No. 62/712,590, filed on Jul. 31, 2018.

(51) Int. Cl.
*A43B 13/18* (2006.01)
*A43B 13/12* (2006.01)

(58) Field of Classification Search
USPC ..... 36/28, 29
See application file for complete search history.

(56) References Cited

U.S. PATENT DOCUMENTS

| | | | | |
|---|---|---|---|---|
| 4,918,838 | A | 4/1990 | Chang | |
| 5,097,607 | A | 3/1992 | Fredericksen | |
| 5,155,927 | A | 10/1992 | Bates et al. | |
| 5,313,717 | A | 5/1994 | Allen et al. | |
| 5,493,792 | A | 2/1996 | Bates et al. | |
| 5,806,209 | A | 9/1998 | Crowley et al. | |
| 6,120,880 | A | 9/2000 | Crow | |
| 6,562,427 | B2 | 5/2003 | Hung | |
| 6,684,532 | B2 | 2/2004 | Greene et al. | |
| 6,883,253 | B2 | 4/2005 | Smith et al. | |
| 7,020,990 | B2 | 4/2006 | Khoury | |
| 11,528,960 | B2 * | 12/2022 | Frank | A43B 13/187 |
| 2002/0121031 | A1 | 9/2002 | Smith et al. | |
| 2003/0093920 | A1 | 5/2003 | Greene et al. | |
| 2003/0192202 | A1 | 10/2003 | Schoenborn et al. | |
| 2004/0237346 | A1 | 12/2004 | Rudy | |
| 2005/0150133 | A1 | 7/2005 | Khoury | |
| 2005/0268490 | A1 | 12/2005 | Foxen | |
| 2006/0021251 | A1 | 2/2006 | Swigart et al. | |
| 2006/0059714 | A1 | 3/2006 | Harmon-Weiss et al. | |
| 2006/0179683 | A1 | 8/2006 | Weiss et al. | |
| 2006/0283046 | A1 | 12/2006 | Mason | |
| 2007/0107258 | A1 | 5/2007 | Umezawa et al. | |
| 2007/0107259 | A1 | 5/2007 | Kilgore et al. | |
| 2007/0107266 | A1 | 5/2007 | Sun | |
| 2007/0113425 | A1 | 5/2007 | Wakley et al. | |
| 2008/0047164 | A1 | 2/2008 | Vindriis | |
| 2008/0086916 | A1 | 4/2008 | Ellis | |
| 2008/0263894 | A1 | 10/2008 | Nakano | |
| 2010/0170107 | A1 | 7/2010 | Tzeng | |
| 2010/0281712 | A1 | 11/2010 | Campbell et al. | |
| 2010/0325914 | A1 | 12/2010 | Peyton | |
| 2012/0102783 | A1 | 5/2012 | Swigart et al. | |
| 2012/0233885 | A1 | 9/2012 | Shaffer et al. | |
| 2013/0160327 | A1 | 6/2013 | Peyton et al. | |
| 2013/0160329 | A1 | 6/2013 | Peyton et al. | |
| 2014/0250728 | A1 | 9/2014 | Devoe et al. | |
| 2015/0257483 | A1 | 9/2015 | Meschter et al. | |
| 2015/0272272 | A1 | 10/2015 | Scofield | |
| 2016/0295964 | A1 | 10/2016 | Hensley et al. | |
| 2017/0119096 | A1 | 5/2017 | Greene | |
| 2018/0064208 | A1 | 3/2018 | Hurd | |
| 2018/0084864 | A1 | 3/2018 | Takada et al. | |
| 2018/0332924 | A1 | 11/2018 | Bailey et al. | |

FOREIGN PATENT DOCUMENTS

| | | | |
|---|---|---|---|
| CN | 105831877 | A | 8/2016 |
| CN | 106604657 | A | 4/2017 |
| CN | 107212521 | A | 9/2017 |
| WO | WO-2006022678 | A2 | 3/2006 |
| WO | WO-2018144756 | A1 | 8/2018 |

OTHER PUBLICATIONS

United States Patent and Trademark Office Office Action for U.S. Appl. No. 16/525,974 dated Nov. 23, 2020.

China National Intellectual Property Administration, First Office Action for application No. 201980056735.7 dated Sep. 6, 2021.

* cited by examiner

SOLE STRUCTURE FOR ARTICLE OF FOOTWEAR

CROSS REFERENCE TO RELATED APPLICATIONS

This application is a continuation of U.S. patent application Ser. No. 17/378,477, which is a continuation of U.S. patent application Ser. No. 16/525,974, filed Jul. 30, 2019, which claims priority under 35 U.S.C. § 119(e) to U.S. Provisional Application 62/712,590, filed on Jul. 31, 2018. The disclosures of these prior applications are considered part of the disclosure of this application and are hereby incorporated by reference in their entireties.

FIELD

The present disclosure relates generally to sole structures for articles of footwear, and more particularly, to sole structures incorporating a cushioning arrangement.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing fluid-filled bladders typically include a bladder formed from two barrier layers of polymer material that are sealed or bonded together. The fluid-filled bladders are pressurized with a fluid such as air, and may incorporate tensile members within the bladder to retain the shape of the bladder when compressed resiliently under applied loads, such as during athletic movements. Generally, bladders are designed with an emphasis on balancing support for the foot and cushioning characteristics that relate to responsiveness as the bladder resiliently compresses under an applied load.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
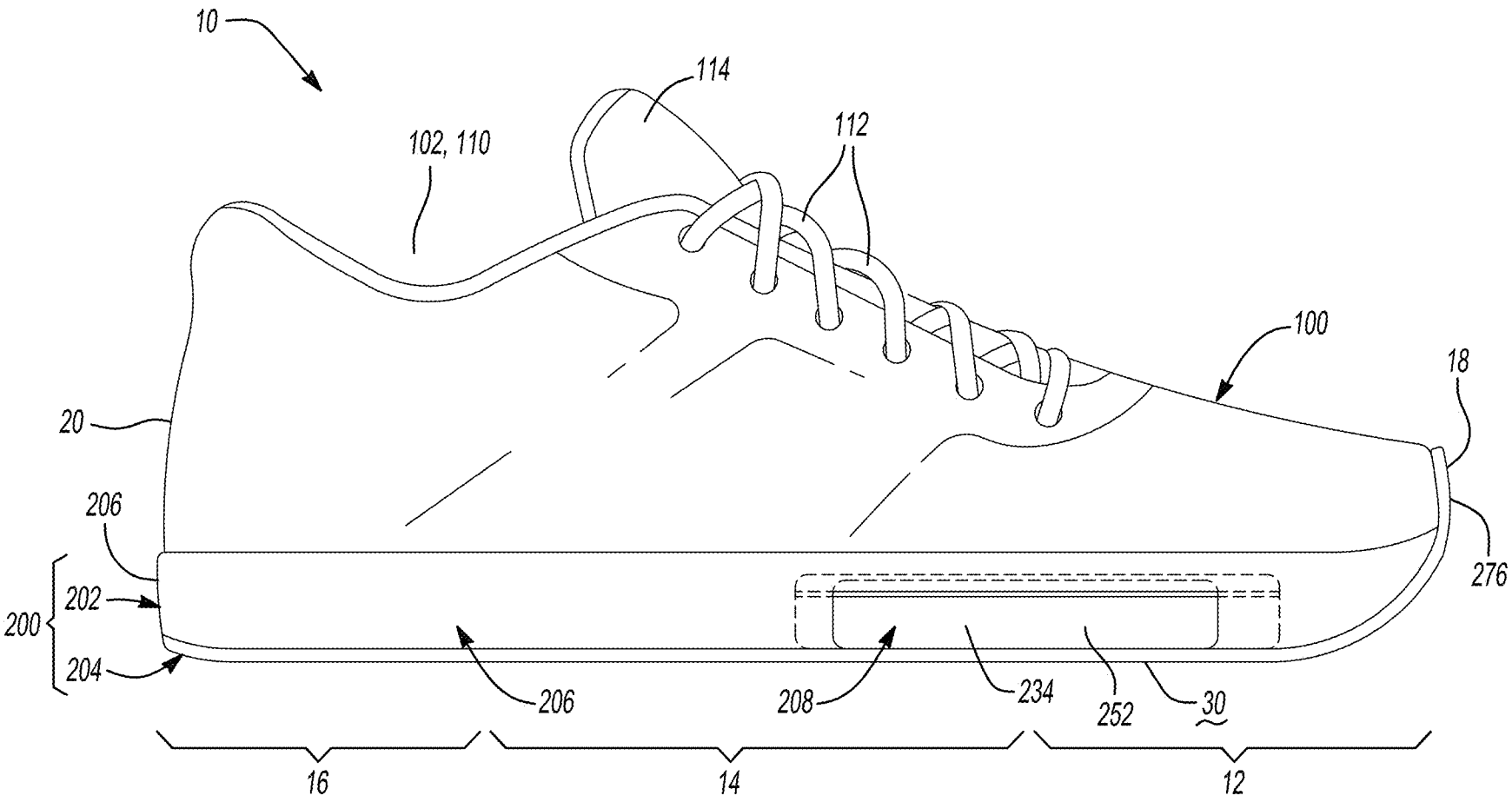
FIG. 1 is a side elevation view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

A sole structure for an article of footwear is provided and includes a foam element having a top surface and a bottom surface formed on an opposite side of the foam element from the top surface. The foam element includes a recess (i) formed in one of the top surface or the bottom surface, (ii) extending from a first end in a forefoot region of the sole structure to a second end in a mid-foot region of the sole structure, (iii) having a first edge extending between the first end and the second end and disposed proximate to a peripheral region of the sole structure, and (iv) having a second edge extending between the first end and the second end and disposed at an interior region of the sole structure. A cushioning arrangement is disposed within the recess and includes an outer surface that is substantially flush with the one of the top surface or the bottom surface of the foam element.

In one configuration, the cushioning arrangement is a bladder that is matingly received by the recess. The bladder may include a tensile member disposed therein. Additionally or alternatively, the bladder may extend continuously from the first end of the recess to the second end of the recess.

The first end of the recess may be curved and/or the second end of the recess may be substantially straight.

The cushioning arrangement may include a first bladder disposed adjacent to the first end of the recess and a second bladder disposed adjacent to the second end of the recess.

In one configuration, the first edge terminates at a distal end spaced apart from the one of the top surface and the bottom surface to form an opening through the peripheral region. The cushioning arrangement may be exposed through the opening.

The first edge may be located at a lateral side of the sole structure. In addition or alternatively, the cushioning arrangement may substantially fill the recess.

A sole structure for an article of footwear is provided and includes a foam element extending from an anterior end of the sole structure to a posterior end of the sole structure along a first longitudinal axis and including a bottom surface having a recess. The recess extending (i) from a first end in a forefoot region of the sole structure to a second end in a mid-foot region of the sole structure and (ii) along a second longitudinal axis that is laterally offset towards a lateral side of the sole structure from the first longitudinal axis. A cushioning arrangement is disposed within and substantially fills the recess, an outer surface of the cushioning arrangement being substantially flush with the bottom surface of the foam element.

In one configuration, the cushioning arrangement is a bladder that is matingly received by the recess. The bladder may include a tensile member disposed therein. Additionally or alternatively, the bladder may extend continuously from the first end of the recess to the second end of the recess.

In one configuration, the first end of the recess may be curved and the second end of the recess may be substantially straight.

The cushioning arrangement may include a first bladder disposed adjacent to the first end of the recess and a second bladder disposed adjacent to the second end of the recess.

An outer edge of the recess may extend through a peripheral side surface of the foam element to form an opening in the peripheral side surface In one configuration, the opening may be formed on the lateral side of the sole structure. Additionally or alternatively, the cushioning arrangement may substantially fill the recess. In some examples, the cushioning arrangement includes a pressurized fluid-filled bladder.

Referring to FIG. 1, an article of footwear 10 includes an upper 100 and sole structure 200. The article of footwear 10 may be divided into one or more regions. The regions may include a forefoot region 12, a mid-foot region 14, and a heel region 16. The forefoot region 12 corresponds to the phalanges and the ball portion of the foot. The mid-foot region 14 may correspond with an arch area of the foot, and the heel region 16 may correspond with rear portions of the foot, including a calcaneus bone.

Figure 3:
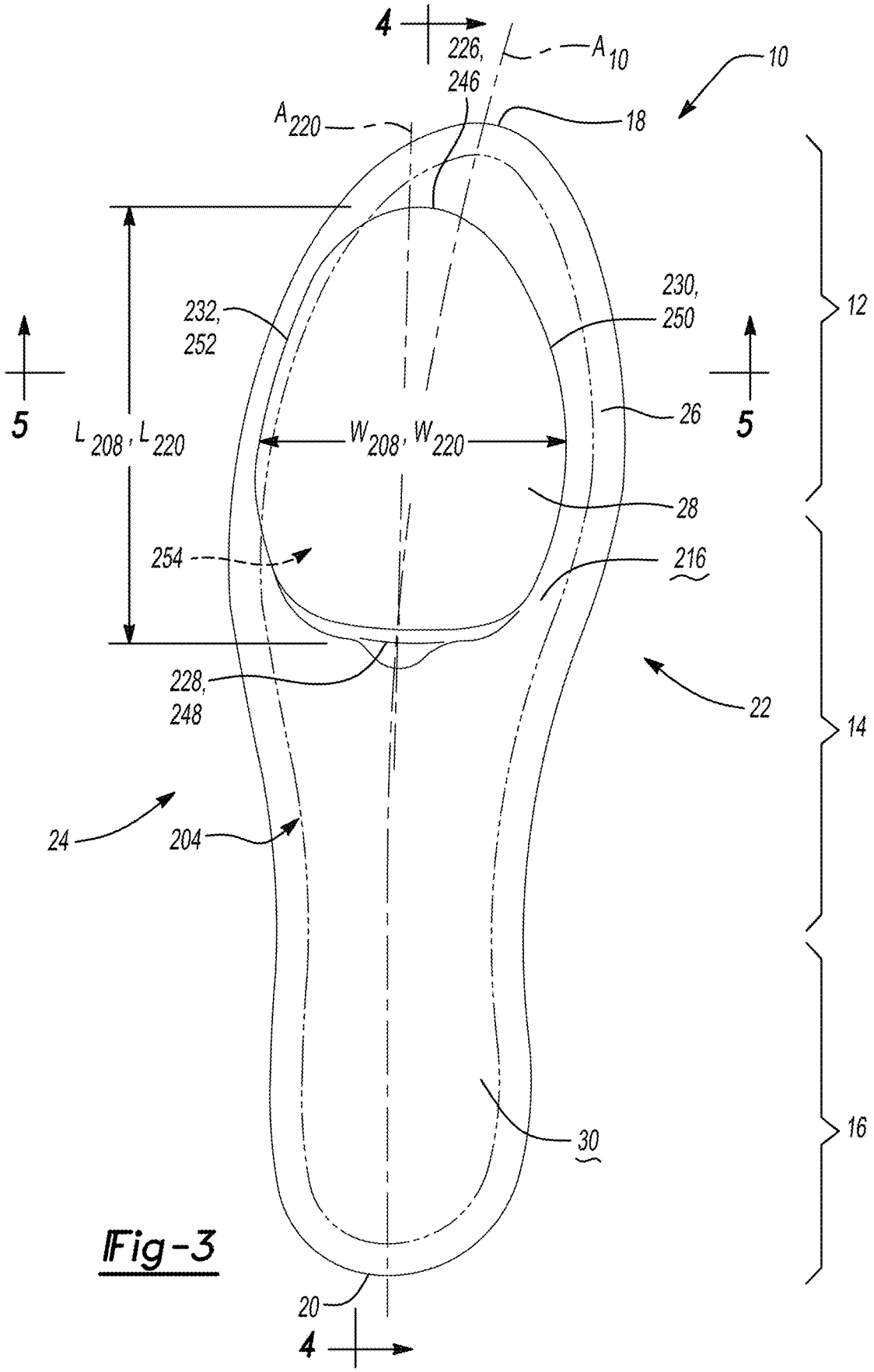
FIG. 3 is a bottom view of the sole structure of article of footwear of FIG. 1.

The footwear 10 may further include an anterior end 18 associated with a forward-most point of the forefoot region 12, and a posterior end 20 corresponding to a rearward-most point of the heel region 16. As shown in FIG. 3, a longitudinal axis $A_{10}$ of the footwear 10 extends along a length of the footwear 10 from the anterior end 18 to the posterior end 20, parallel to a ground surface. As shown, the longitudinal axis $A_{10}$ is centrally located along the length of the footwear 10, and generally divides the footwear 10 into a medial side 22 and a lateral side 24. Accordingly, the medial side 22 and the lateral side 24 respectively correspond with opposite sides of the footwear 10 and extend through the regions 12, 14, 16. As used herein, a longitudinal direction refers to the direction extending from the anterior end 18 to the posterior end 20, while a lateral direction refers to the direction transverse to the longitudinal direction and extending from the medial side 22 to the lateral side 24.

The article of footwear 10, and more particularly, the sole structure 200, may be further described as including a peripheral region 26 and an interior region 28, as signified by the phantom line in FIG. 3. The peripheral region 26 is generally described as being a region between the interior region 28 and an outer perimeter of the sole structure 200. Particularly, the peripheral region 26 extends from the forefoot region 12 to the heel region 16 along each of the medial side 22 and the lateral side 24, and wraps around each of the forefoot region 12 and the heel region 16. The interior region 28 is circumscribed by the peripheral region 26, and extends from the forefoot region 12 to the heel region 16 along a central portion of the sole structure 200. Accordingly, each of the forefoot region 12, the mid-foot region 14, and the heel region 16 may be described as including the peripheral region 26 and the interior region 28.

With reference to FIG. 1, the upper 100 includes interior surfaces that define an interior void 102 configured to receive and secure a foot for support on sole structure 200. The upper 100 may be formed from one or more materials that are stitched or adhesively bonded together to form the interior void 102. Suitable materials of the upper 100 may include, but are not limited to, mesh, textiles, foam, leather, and synthetic leather. The materials may be selected and located to impart properties of durability, air-permeability, wear-resistance, flexibility, and comfort.

Figure 4:
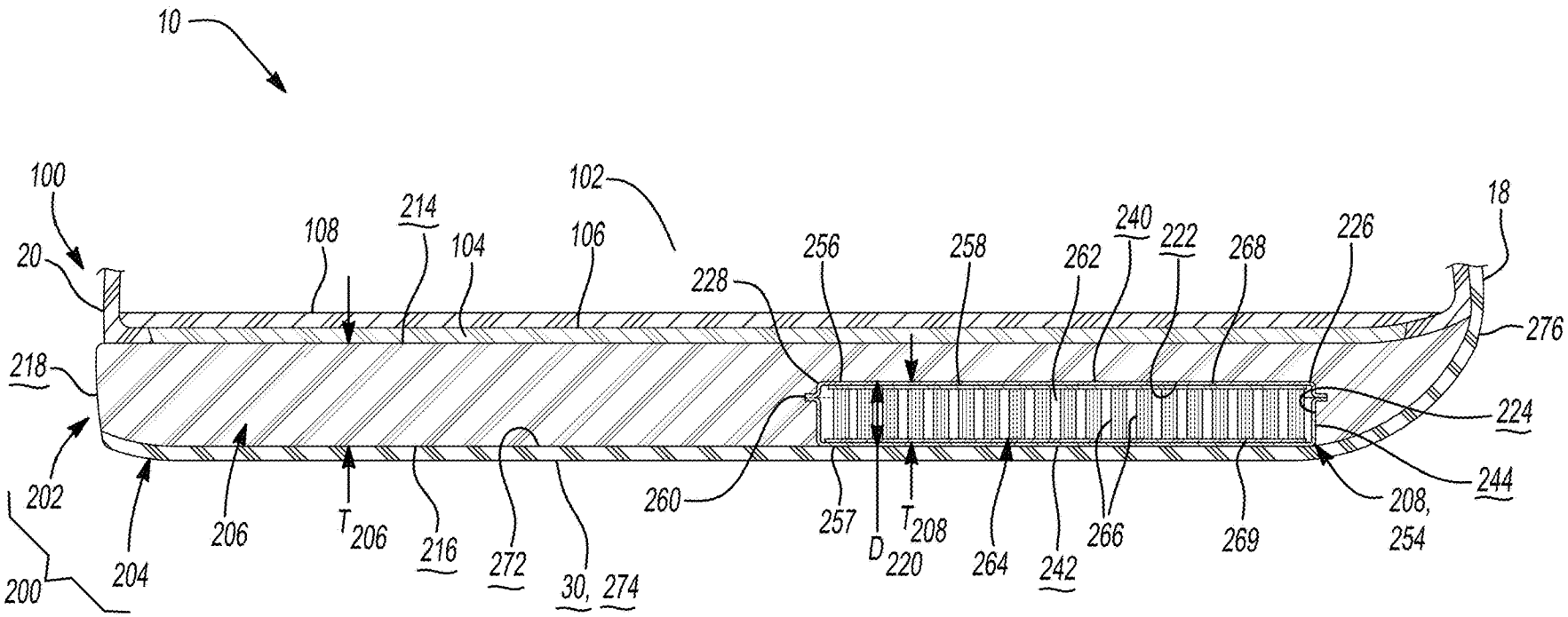
FIG. 4 is a cross-sectional view of the article of footwear of FIG. 1, taken along line 4-4 of FIG. 3 and corresponding to a longitudinal axis of the article of footwear.
Figure 5:
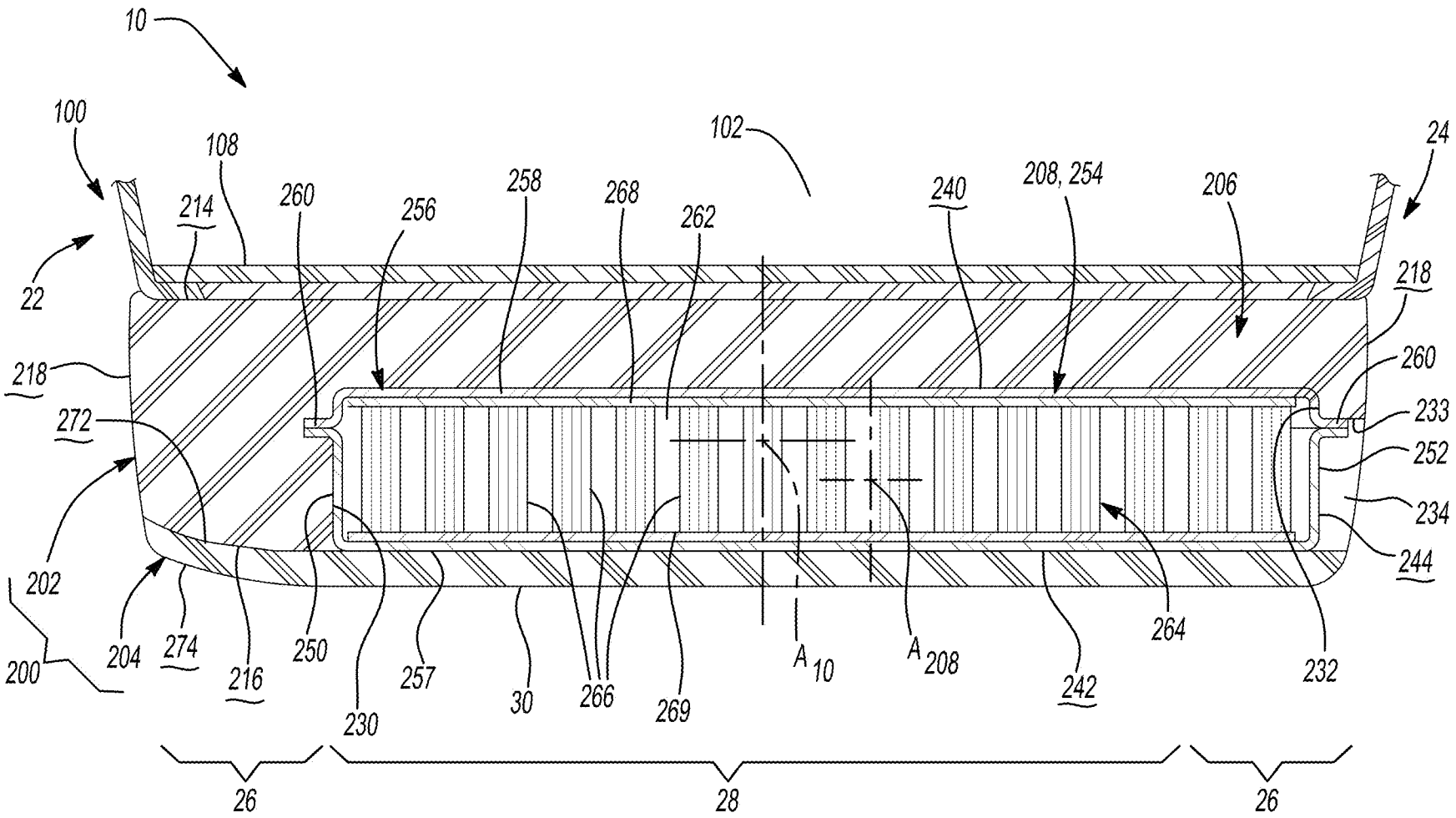
FIG. 5 is a cross-sectional view of the article of footwear of FIG. 1, taken along line 5-5 of FIG. 3 and corresponding to a forefoot region of the article of footwear.

As best shown in the cross-sectional view of FIG. 4, in some examples, the upper 100 includes a strobel 104 having a bottom surface opposing the sole structure 200 and an opposing top surface forming a footbed 106 of the interior void 102. Stitching or adhesives may secure the strobel to the upper 100. The footbed 106 may be contoured to conform to a profile of the bottom surface (e.g., plantar) of the foot. Optionally, the upper 100 may also incorporate additional layers such as an insole or sockliner 108 that may be disposed upon the strobel 104 and reside within the interior void 102 of the upper 100 to receive a plantar surface of the foot to enhance the comfort of the article of footwear 10.

An ankle opening 110 in the heel region 16 may provide access to the interior void 102. For example, the ankle opening 110 may receive a foot to secure the foot within the void 102 and to facilitate entry and removal of the foot from and to the interior void 102. In some examples, one or more fasteners 112 extend along the upper 100 to adjust a fit of the interior void 102 around the foot and to accommodate entry and removal of the foot therefrom. The upper 100 may include apertures, such as eyelets and/or other engagement features such as fabric or mesh loops that receive the fasteners 112. The fasteners 112 may include laces, straps, cords, hook-and-loop, or any other suitable type of fastener. The upper 100 may include a tongue portion 114 that extends between the interior void 102 and the fasteners 112.

With reference to FIG. 1, the sole structure 200 includes a midsole 202 configured to provide cushioning characteristics of the sole structure 200, and an outsole 204 configured to provide a ground-engaging surface 30 of the article of footwear 10. Unlike conventional sole structures, the midsole 202 is formed compositely and includes a plurality of subcomponents for providing zonal cushioning and performance characteristics to the sole structure 200. For example, the midsole 202 includes a foam element 206 and a cushioning arrangement 208, which cooperate to define a bottom surface of the midsole 202 for attaching the outsole 204. As described in greater detail below, the outsole 204 is attached to a bottom surface of the midsole 202 and forms the ground-engaging surface 30 of the footwear 10. The foam element 206, the cushioning arrangement 208, and the outsole 204 may be assembled and secured to each other using various methods of bonding, including adhesively bonding and melding, for example.

Figure 2:
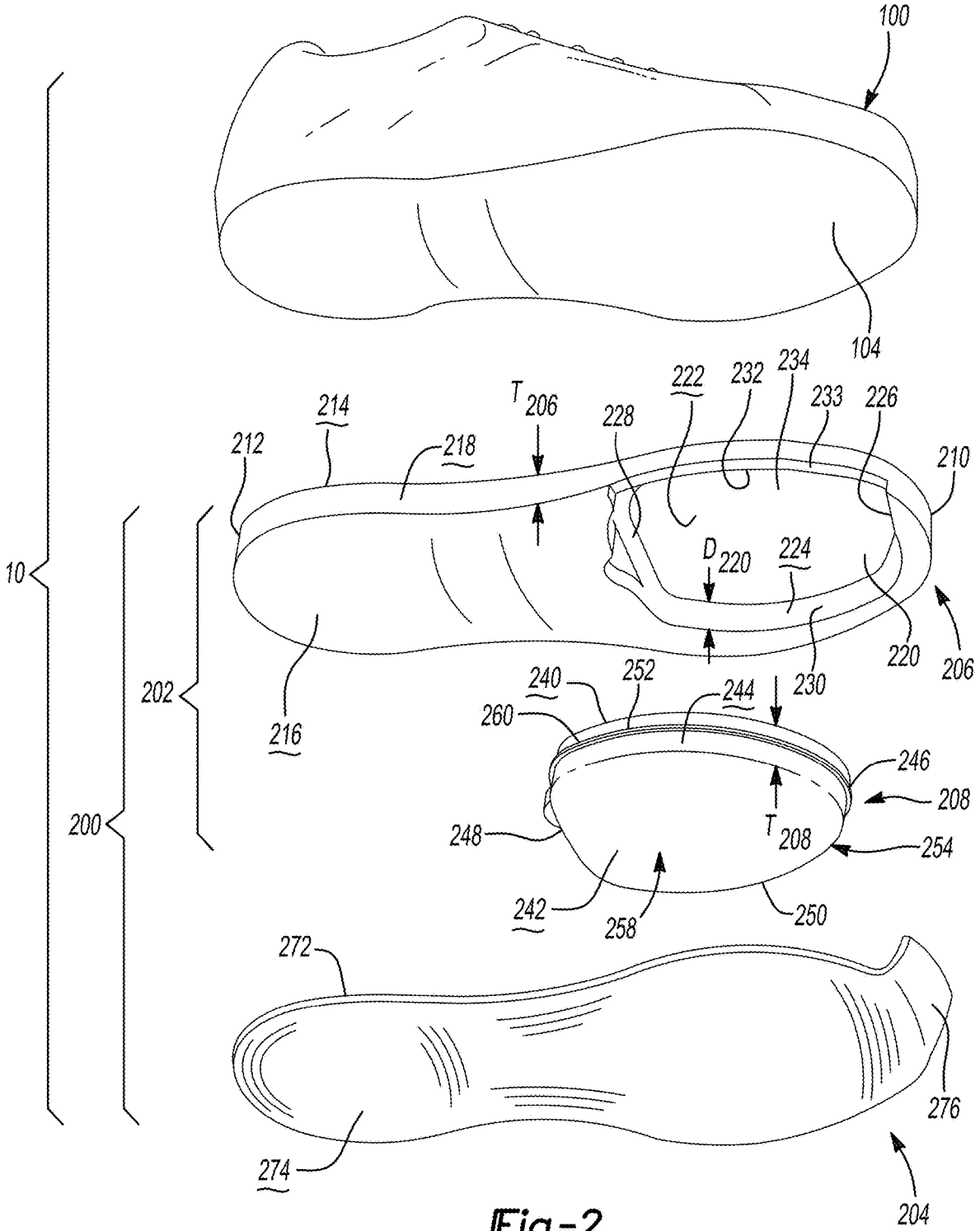
FIG. 2 is an exploded view of the article of footwear of FIG. 1, showing the article of footwear having an upper and a sole structure arranged in a layered configuration.

Referring to FIG. 2, the foam element 206 extends from a first end 210 at the anterior end 18 of the footwear 10 to a second end 212 at the posterior end 20 of the footwear 10. In some examples, the foam element 206 may be a unitary foam element 206 comprising a single, continuous body extending from the anterior end 18 to the posterior end 20. The foam element 206 includes a top surface 214 and a bottom surface 216 formed on an opposite side of the foam element 206 from the top surface 214, whereby a distance between the top surface 214 and the bottom surface 216 defines a thickness $T_{206}$ of the foam element 206. As discussed in greater detail below, the thickness $T_{206}$ of the foam element 206 may be variable. A peripheral side surface 218 extends between the top surface 214 and the bottom surface 216 and defines an outer peripheral profile of the foam element 206.

The foam element 206 includes a recess 220 formed in the bottom surface 216. The recess 220 is defined by an intermediate surface 222 disposed between the top surface 214 and the bottom surface 216 and a peripheral wall 224 extending from the intermediate surface 222 to the bottom surface 216. Accordingly, a depth $D_{220}$ of the recess 220 is defined by a distance from the bottom surface 216 to the intermediate surface 222, while an outer profile of the recess 220 is defined by the peripheral wall 224.

The recess 220 extends along the length of the foam element 206 from a first end 226 in the forefoot region 12 to a second end 228 in the mid-foot region 14. The recess 220 further includes an inner side 230 and an outer side 232 formed on an opposite side of the recess 220 from the inner side 230. The inner side 230 and the outer side 232 extend from the first end 226 to the second end 228, whereby a maximum distance from the first end 226 to the second end 228 defines a length $L_{220}$ of the recess 220 and a maximum distance from the inner side 230 to the outer side 232 defines a width $W_{220}$ of the recess 220, as indicated in FIG. 3. As shown, a longitudinal axis $A_{220}$ of the recess 220 extends from the first end 226 to the second end 228, and is centrally located between the inner side 230 and the outer side 232 of the recess 220.

Generally, the recess 220 is laterally offset relative to the longitudinal axis $A_{10}$ of the footwear 10, whereby the longitudinal axis $A_{220}$ of the recess 220 is spaced apart from and extends along the same direction as the longitudinal axis $A_{10}$ of the footwear 10. In other words, a distance that the inner side 230 is spaced apart from the peripheral side surface 218 is greater than a distance that the outer side 232 is spaced apart from the peripheral side surface 218. In some examples, the inner side 230 of the recess 220 is formed in the interior region 28 of the sole structure 200, while the outer side 232 is formed in the peripheral region 26 of the sole structure 200.

In a particular example, the recess 220 is offset towards the lateral side 24 of the sole structure 200, whereby the outer side 232 is formed proximate to the peripheral side surface 218 along the lateral side 24, and the inner side 230 is spaced apart from the peripheral side surface 218 on the medial side 22. As shown, the portion of the peripheral wall 224 defining the outer side 232 of the recess 220 may extend only partially from the intermediate surface 222 to the bottom surface 216, whereby a terminal end 233 of the peripheral wall 224 defines an opening 234 that extends through the peripheral side surface 218 of the foam element 206. Conversely, a portion of the peripheral wall 224 defining the inner side 230 extends completely from the intermediate surface 222 to the bottom surface 216 to fully enclose the recess 220 along the medial side 22. In some examples, the outer side 232 is formed in the peripheral region 26 on the lateral side 24, while the inner side 230 is formed in the interior region 28. In some examples, the inner side 230 of the recess 220 may be formed between the longitudinal axis $A_{10}$ and the peripheral side surface 218 on the medial side 22, as shown in FIG. 3.

Referring still to FIG. 3, the bottom surface 216 of the foam element 206 extends between the inner side 230 of the recess 220 and the peripheral side surface 218, from the first end 226 of the recess 220 to the second end 228 of the recess 220. Accordingly, the sole structure 200 is configured to provide zonal cushioning in the forefoot region 12 and the mid-foot region 14, whereby the cushioning arrangement 208 defines cushioning properties of the sole structure 200 on the lateral side 24 in the forefoot region 12 and the mid-foot region 14, while the foam element 206 defines the cushioning properties of the sole structure along the medial side 22 of the forefoot region 12 and the mid-foot region 14.

As discussed in greater detail below, the peripheral wall 224 of the recess 220 is configured to cooperate with an outer peripheral profile of the cushioning arrangement 208, whereby the cushioning arrangement 208 substantially fills the recess 220. Accordingly, the profile of the peripheral wall 224 will correspond to the profile of the desired cushioning arrangement 208. For example, as shown in FIG. 2, the cushioning arrangement 208 be a unitary structure extending continuously from the first end 226 of the recess 220 to the second end 228 of the recess 220. Here, the first end 226 of the recess 220 may be arcuate to accommodate an arcuate outer perimeter of the cushioning arrangement 208, while the second end 228 of the recess 220 is substantially straight to accommodate a corresponding profile of the cushioning arrangement 208. As shown, the inner side 230 extends along a continuous arcuate path through the interior region 28 on the medial side 22. Likewise, the outer side 232 extends along a continuous arcuate path along the peripheral region 26 on the lateral side 24.

Referring to FIG. 2, the cushioning arrangement 208 includes a top surface 240 and a bottom surface 242 formed on an opposite side of the cushioning arrangement 208 from the top surface 240 such that a distance between the top surface 240 and the bottom surface 242 defines a thickness $T_{208}$ of the cushioning arrangement 208. An outer peripheral surface 244 extends between the top surface 240 and the bottom surface 242 and defines the outer peripheral profile of the cushioning arrangement 208.

As shown in FIG. 4, the thickness $T_{208}$ of the cushioning arrangement 208 is substantially similar to the depth $D_{220}$ of the recess 220 such that the bottom surface 242 of the cushioning arrangement 208 is flush with the bottom surface 216 of the foam element 206 when the top surface 240 of the cushioning arrangement 208 is interfaced with (i.e., contacts) the intermediate surface 222 of the recess 220. Accordingly, the bottom surface 216 of the foam element 206 and the bottom surface 242 of the cushioning arrangement 208 cooperate to define a substantially continuous, planar load-bearing bottom surface of the midsole 202.

The cushioning arrangement 208 extends from a first end 246 to second end 248 formed at an opposite end of the cushioning arrangement 208 from the first end 246. The cushioning arrangement 208 further includes an inner side 250 and an outer side 252 formed on an opposite side of the cushioning arrangement 208 from the inner side 250. The inner side 250 and the outer side 252 extend from the first end 246 to the second end 248, whereby a maximum distance from the first end 246 to the second end 248 defines a length $L_{208}$ of the cushioning arrangement 208, and a maximum distance from the inner side 250 to the outer side 252 defines a width $W_{208}$ of the cushioning arrangement 208, as best shown in FIG. 3.

The length $L_{208}$ and the width $W_{208}$ of the cushioning arrangement 208 are substantially similar to the length $L_{220}$ and the width $W_{220}$ of the recess 220. Similarly, profiles of the first end 246, the second end 248, the inner side 250, and the outer side 252 of the cushioning arrangement 208, which are defined by the peripheral surface 244, correspond to profiles of the first end 226, the second end 228, the inner side 230, and the outer side 232 of the recess 220. Accordingly, when the cushioning arrangement 208 is disposed within the recess 220, the outer peripheral surface 244 of the cushioning arrangement 208 is received by and contacts the peripheral wall 224 of the recess 220, such that the cushioning arrangement 208 substantially fills the recess 220. Accordingly, the cushioning arrangement 208 is inherently arranged in the same position as the recess 220.

As discussed above, the portion of the peripheral wall 224 forming the outer side 232 of the recess 220 may extend partially from the intermediate surface 222 to the bottom surface 216, whereby the opening 234 extends from the peripheral side surface 218 to the recess 220 on the lateral side 24. Accordingly, the outer side 252 of the cushioning arrangement 208 may be exposed through the opening 234, as shown in FIG. 1. In some examples, the outer side 252 of the cushioning arrangement 208 is recessed inwardly from the peripheral side surface 218. Alternatively, the outer side 252 of the cushioning arrangement 208 may extend at least partially through the opening 234 such that the outer side 252 of the cushioning arrangement 208 cooperates with the peripheral side surface 218 to form a substantially continuous outer surface of the sole structure 200.

As shown in the example of FIG. 2, the cushioning arrangement 208 is formed as a unitary cushioning arrangement 208 and includes a single bladder 254 positioned along the lateral side 24 of the sole structure and extending from the forefoot region 12 to the mid-foot region 14. Here, the outer side 252 of the cushioning arrangement 208 is proximate the lateral side 24 of the sole structure 200 while the inner side 250 is disposed within the interior region 28 of the sole structure 200. In one example of a unitary cushioning arrangement 208, the bladder 254 extends continuously from the first end 246 of the cushioning arrangement 208 to the second end 248 of the cushioning arrangement, as shown in FIG. 2. Accordingly, each of the inner side 250 and the outer side 252 of the cushioning arrangement 208 are continuously formed and extend along an arcuate path from the first end 246 to the second end 248. Likewise, the top surface 240 and the bottom surface 242 are continuously formed from the first end 246 to the second end 248 and from the inner side 230 to the outer side 232. In some examples, the first end 246 may be arcuate while the second end 248 is straight, as illustrated in FIG. 3.

As explained in greater detail below, the physical properties of foam element 206 and the cushioning arrangement 208 are different. For example, the foam element 206 may have a first stiffness for providing greater cushioning and impact distribution, while the cushioning arrangement 208 may have a second stiffness in order to provide increased responsiveness to the lateral side 24 of the sole structure 200. In the illustrated examples, the foam element 206 includes a solidly-formed polymeric material, while the cushioning arrangement 208 includes a bladder 254.

As shown in FIG. 2, the outsole 204 includes an interior surface 272 and an exterior surface 274 formed on an opposite side of the outsole 204 from the interior surface 272. As discussed above, the bottom surface 216 of the foam element 206 and the bottom surface 242 of the cushioning arrangement 208 cooperate to form a substantially continuous bottom surface of the midsole 202 to which the interior surface 272 of the outsole 204 is attached. In the illustrated example, the outsole 204 extends continuously from the anterior end 18 to the posterior end 20 and from the medial side 22 to the lateral side 24, whereby the exterior surface 274 of the outsole forms the ground-engaging surface 30 of the footwear 10. In other implementations, the outsole 204 may be fragmentary, where the outsole 204 includes a plurality of outsole portions distributed along the bottom surface of the midsole 202. In some examples, the outsole 204 extends over the anterior end 18 of the footwear and forms a toe cap 276 of the footwear. The outsole 204 may be formed from a resilient material such as, for example, rubber that provides the article of footwear 10 with a ground-engaging surface 30 that provides traction and durability.

Referring now to FIGS. 6-10, an article of footwear 10*a* is provided and includes an upper 100 and a sole structure 200*a* attached to the upper 100. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

Figure 7:
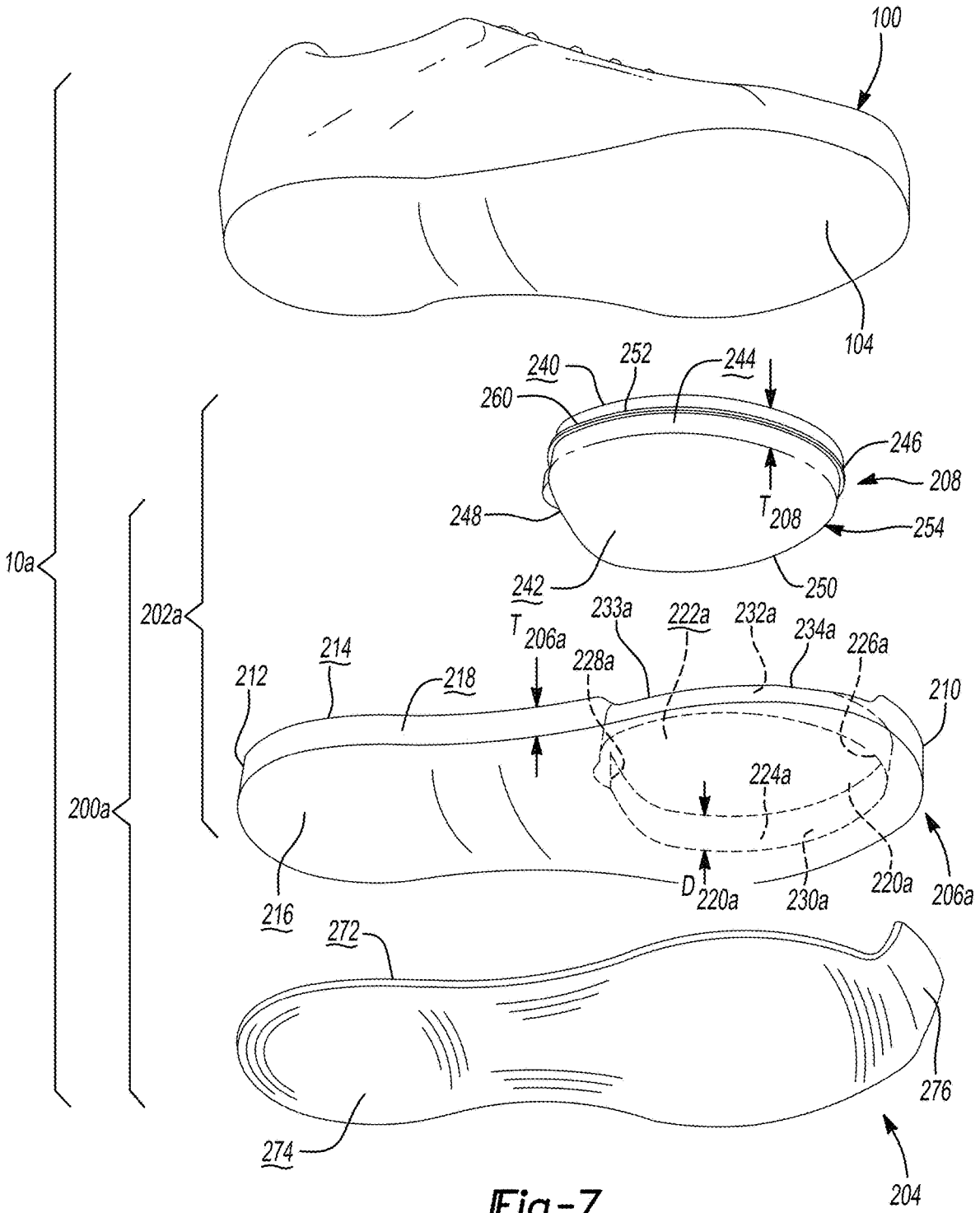
FIG. 7 is an exploded view of the article of footwear of FIG. 6, showing the article of footwear having an upper and a sole structure arranged in a layered configuration.

With reference to FIG. 7, the sole structure 200*a* includes a midsole 202*a* configured to provide cushioning characteristics of the sole structure 200*a*, and an outsole 204 configured to provide a ground-engaging surface 30 of the article of footwear 10*a*. The midsole 202*a* is formed compositely and includes a plurality of subcomponents for providing zonal cushioning and performance characteristics to the sole structure 200*a*. For example, the midsole 202*a* includes a foam element 206*a* and the cushioning arrangement 208, which cooperate to define a top surface of the midsole 202*a* for attaching the outsole 204. The outsole 204 is attached to a bottom surface 216 of the midsole 202*a* and forms the ground-engaging surface 30 of the footwear 10*a*. The foam element 206*a*, the cushioning arrangement 208, and the outsole 204 may be assembled and secured to each other using various methods of bonding, including adhesively bonding and melding, for example.

As shown, the foam element 206*a* of FIG. 7 includes a recess 220*a* formed in the top surface 214. The recess 220*a* is defined by an intermediate surface 222*a* disposed between the top surface 214 and the bottom surface 216 and a peripheral wall 224*a* extending from the intermediate surface 222*a* to the top surface 214. Accordingly, a depth $D_{220a}$ of the recess 220*a* is defined by a distance from the top surface 214 to the intermediate surface 222*a*, while an outer profile of the recess 220*a* is defined by the peripheral wall 224*a*.

Figure 8:
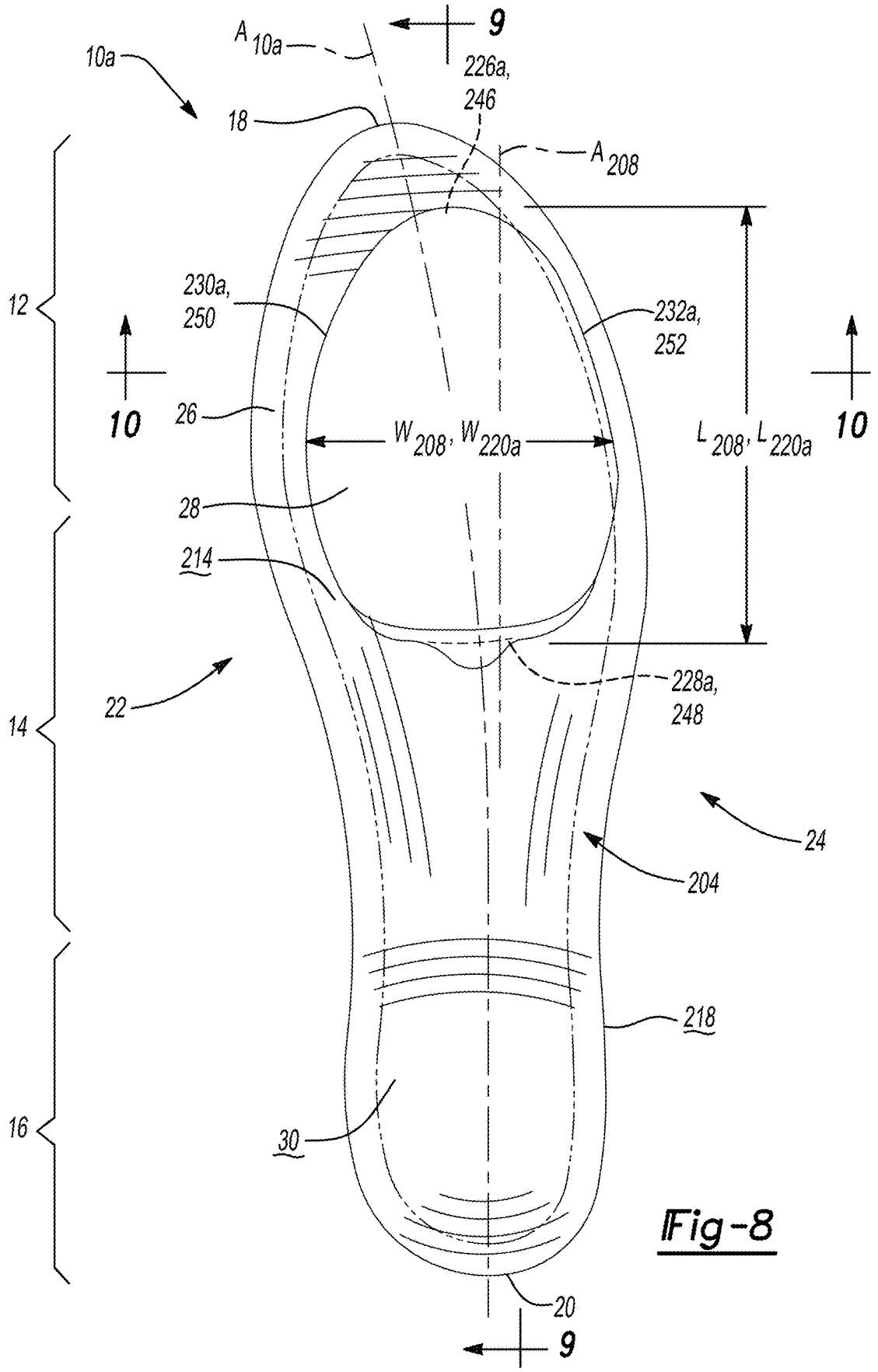
FIG. 8 is a top view of the sole structure of the article of footwear of FIG. 6.
Figure 9:
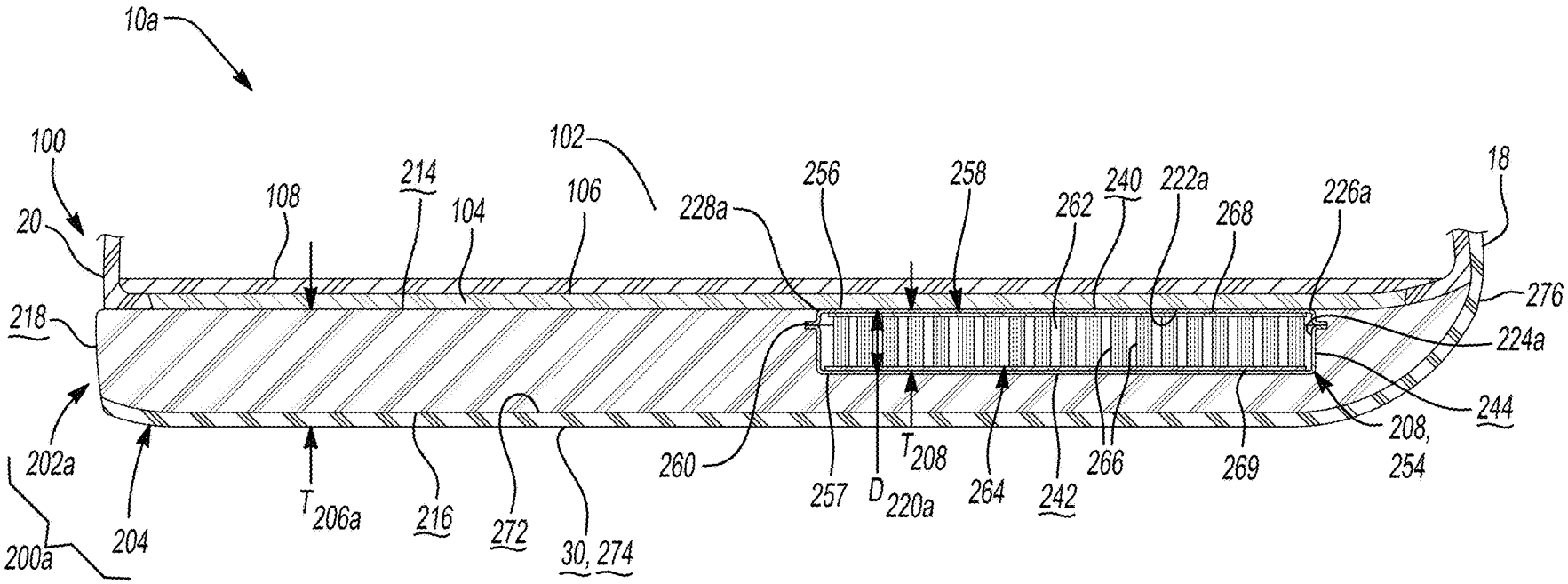
FIG. 9 is a cross-sectional view of the article of footwear of FIG. 6, taken along line 9-9 of FIG. 8 and corresponding to a longitudinal axis of the article of footwear.
Figure 10:
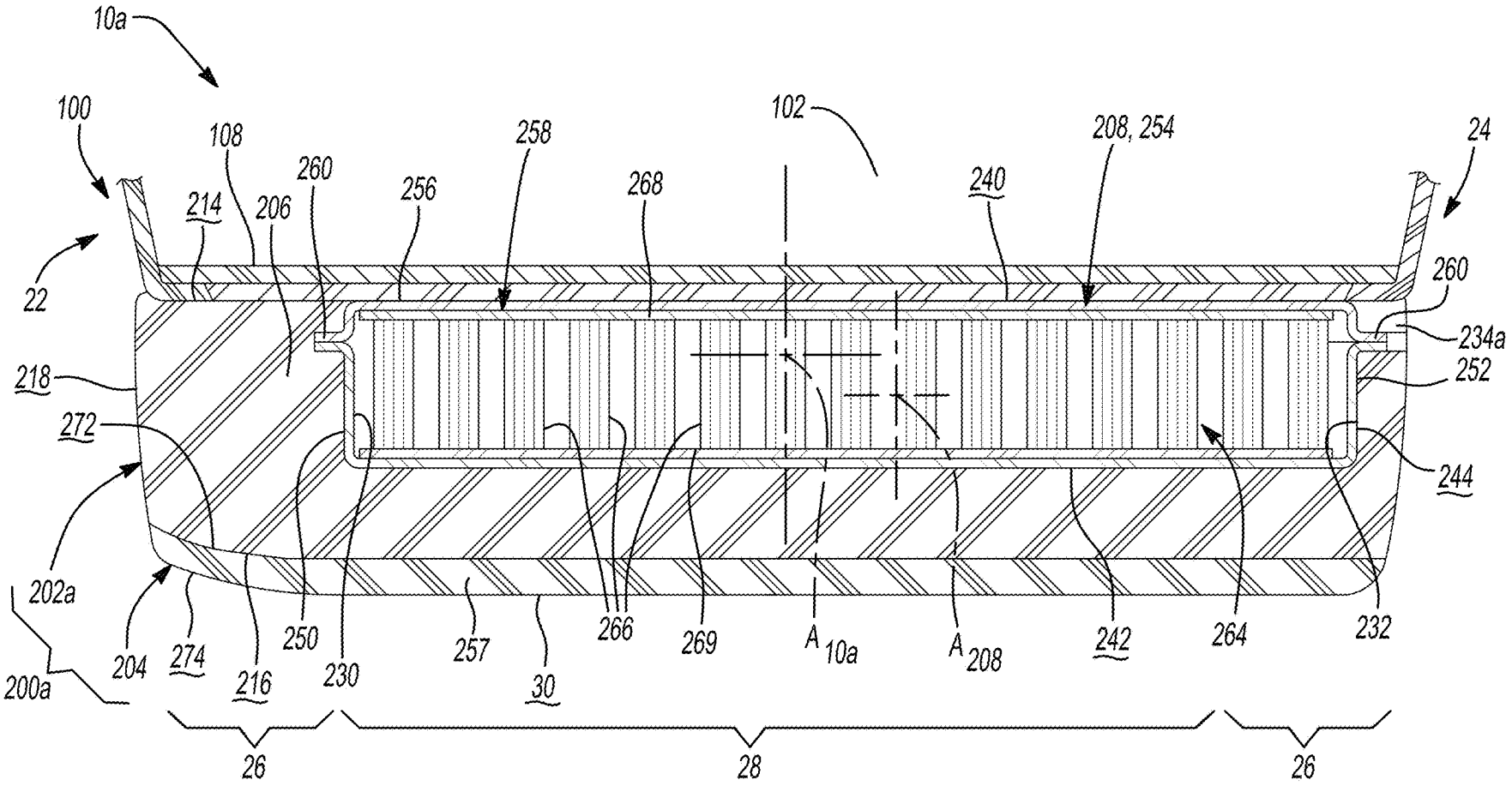
FIG. 10 is a cross-sectional view of the article of footwear of FIG. 6, taken along line 10-10 of FIG. 8 and corresponding to a forefoot region of the article of footwear.

The recess 220*a* extends along the length of the foam element 206*a* from a first end 226*a* in the forefoot region 12 to a second end 228*a* in the mid-foot region 14. The recess 220*a* further includes an inner side 230*a* and an outer side 232*a* formed on an opposite side of the recess 220*a* from the inner side 230*a*. The inner side 230*a* and the outer side 232*a* extend from the first end 226*a* to the second end 228*a*, whereby a distance from the first end 226*a* to the second end 228*a* defines a length $L_{220a}$ of the recess 220*a* and a distance from the inner side 230*a* to the outer side 232*a* defines a width $W_{220a}$ of the recess 220*a*. As shown in FIG. 8, a longitudinal axis $A_{220a}$ of the recess 220*a* extends from the first end 226*a* to the second end 228*a*, and is centrally located between the inner side 230*a* and the outer side 232*a* of the recess 220*a*.

Generally, the recess 220*a* is laterally offset relative to the longitudinal axis $A_{10a}$ of the footwear 10*a*, whereby the longitudinal axis $A_{220a}$ of the recess 220*a* is spaced apart from and extends along the same direction as the longitudinal axis $A_{10a}$ of the footwear 10*a*. Put another way, a distance that the inner side 230*a* is spaced apart from the peripheral side surface 218 is greater than a distance that the outer side 232*a* is spaced apart from the peripheral side surface 218. In some examples, the inner side 230*a* of the recess 220*a* is formed in the interior region 28 of the sole structure 200*a*, while the outer side 232*a* is formed in the peripheral region 26 of the sole structure 200*a*.

In a particular example, the recess 220*a* is offset towards the lateral side 24 of the sole structure 200*a*, whereby the outer side 232*a* is formed proximate to the peripheral side surface 218 along the lateral side 24, and the inner side 230*a* is spaced apart from the peripheral side surface 218 on the medial side 22. As shown, a portion of the peripheral wall 224*a* defining the outer side 232*a* of the recess 220*a* may extend only partially from the intermediate surface 222*a* to the top surface 214, whereby a terminal end 233*a* of the peripheral wall 224*a* defines an opening 234*a* that extends through the peripheral side surface 218 of the foam element 206*a*. Conversely, a portion of the peripheral wall 224*a* defining the inner side 230*a* extends completely from the intermediate surface 222*a* to the top surface 214 to fully enclose the recess 220*a* along the medial side 22. In some examples, the outer side 232*a* is formed in the peripheral region 26 on the lateral side 24, while the inner side 230*b* is formed in the interior region 28. In some examples, the inner side 230*a* of the recess 220*a* may be formed proximate to the longitudinal axis $A_{10a}$ of the footwear 10*a*.

As shown in FIG. 8, the top surface 214 of the foam element 206*a* extends from the inner side 230*a* of the recess 220*a* to the peripheral side surface 218 along the medial side of the recess 220*a* from the first end 226*a* of the recess 220*a* to the second end 228*a* of the recess 220*a*. Accordingly, the sole structure 200*a* is configured to provide zonal cushioning properties through the forefoot region 12 and the mid-foot region 14, whereby the cushioning arrangement 208 defines cushioning properties of the sole structure 200*a* on the lateral side 24 in the forefoot region 12 and the mid-foot region 14, while the foam element 206*a* defines the cushioning properties of the sole structure 200*a* along the medial side 22 of the forefoot region 12 and the mid-foot region 14.

As discussed in greater detail below, the peripheral wall 224*a* of the recess 220*a* is configured to cooperate with an outer peripheral profile of the cushioning arrangement 208 such that the cushioning arrangement 208 substantially fills the recess 220*a*. Accordingly, the profile of the peripheral wall 224*a* will correspond to the profile of the cushioning arrangement 208. For example, as shown in FIG. 7, the cushioning arrangement 208 is a unitary structure extending continuously from the first end 226*a* of the recess 220*a* to the second end 228*a* of the recess 220*a*. Here, the first end 226*a* of the recess 220*a* may be arcuate to accommodate an arcuate outer perimeter of the cushioning arrangement 208, while the second end 228*a* of the recess 220*a* is substantially straight to accommodate a corresponding profile of the cushioning arrangement 208. As shown, the inner side 230*a* extends along a continuous arcuate path through the interior region 28 on the medial side 22. Likewise, the outer side 232*a* extends along a continuous arcuate path along the peripheral region 26 on the lateral side 24.

Referring to FIG. 7, the cushioning arrangement 208 includes a top surface 240 and a bottom surface 242 formed on an opposite side of the cushioning arrangement 208 from the top surface 240 such that a distance from the top surface 240 to the bottom surface 242 defines a thickness $T_{208}$ of the cushioning arrangement 208. An outer peripheral surface 244 extends between the top surface 240 and the bottom surface 242 and defines the outer peripheral profile of the cushioning arrangement 208.

As shown in FIG. 8, the thickness $T_{208}$ of the cushioning arrangement 208 is substantially similar to the depth $D_{220a}$ of the recess 220*a*, whereby the top surface 240 of the cushioning arrangement 208 is flush with the top surface 214 of the foam element 206*a* when the bottom surface 242 of the cushioning arrangement 208 is interfaced with (i.e. contacts) the intermediate surface 222*a* of the recess 220*a*. Accordingly, the top surface 214 of the foam element 206*a* and the top surface 240 of the cushioning arrangement 208 cooperate to define a substantially continuous, load-bearing top surface of the midsole 202*a*.

The length $L_{208}$ and the width $W_{208}$ of the cushioning arrangement 208 are substantially similar to the length $L_{220a}$ and the width $W_{220a}$ of the recess 220*a*. Similarly, profiles of the first end 246, the second end 248, the inner side 250, and the outer side 252 of the cushioning arrangement 208, which are defined by the peripheral surface 244, correspond to profiles of the first end 226*a*, the second end 228*a*, the inner side 230*a*, and the outer side 232*a* of the recess 220*a*. Accordingly, when the cushioning arrangement 208 is disposed within the recess 220*a*, the outer peripheral surface 244 of the cushioning arrangement 208 is received by and contacts the peripheral wall 224*a* of the recess 220*a*, such that the cushioning arrangement substantially fills the recess 220*a*. Accordingly, the cushioning arrangement 208 is inherently arranged in the same position as the recess 220*a*, as discussed above.

Figure 6:
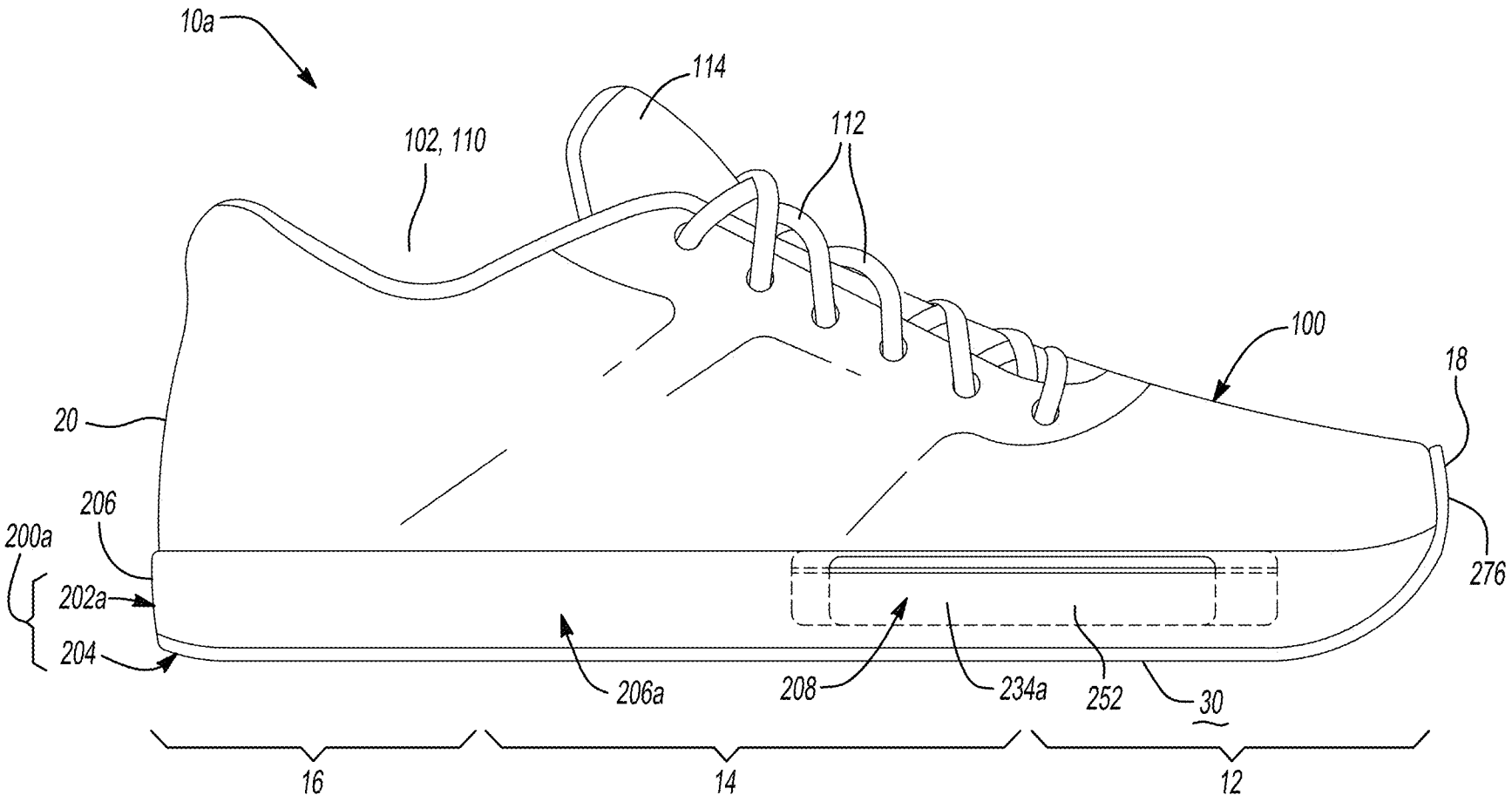
FIG. 6 is a side elevation view of an article of footwear in accordance with principles of the present disclosure.

As discussed above, the portion of the peripheral wall 224*a* forming the outer side 232*a* of the recess 220*a* extends partially from the intermediate surface 222*a* to the top surface 214, whereby the opening 234*a* extends from the peripheral side surface 218 and to the recess 220*a*. Accordingly, the outer side 252 of the cushioning arrangement 208 may be exposed through the opening 234*a*, as shown in FIG. 6. In some examples, the outer side 252 of the cushioning arrangement 208 is recessed inwardly from the peripheral side surface 218. Alternatively, the outer side 252 of the cushioning arrangement 208 may extend at least partially through the opening 234*a*, whereby the outer side 252 of the cushioning arrangement 208 cooperates with the peripheral side surface 218 to form a substantially continuous outer surface of the sole structure 200*a*.

Referring now to FIGS. 11-15, an article of footwear 10*b* is provided and includes an upper 100 and a sole structure 200*b* attached to the upper 100. In view of the substantial similarity in structure and function of the components associated with the article of footwear 10 with respect to the article of footwear 10*b*, like reference numerals are used hereinafter and in the drawings to identify like components, while like reference numerals containing letter extensions are used to identify those components that have been modified.

Figure 12:
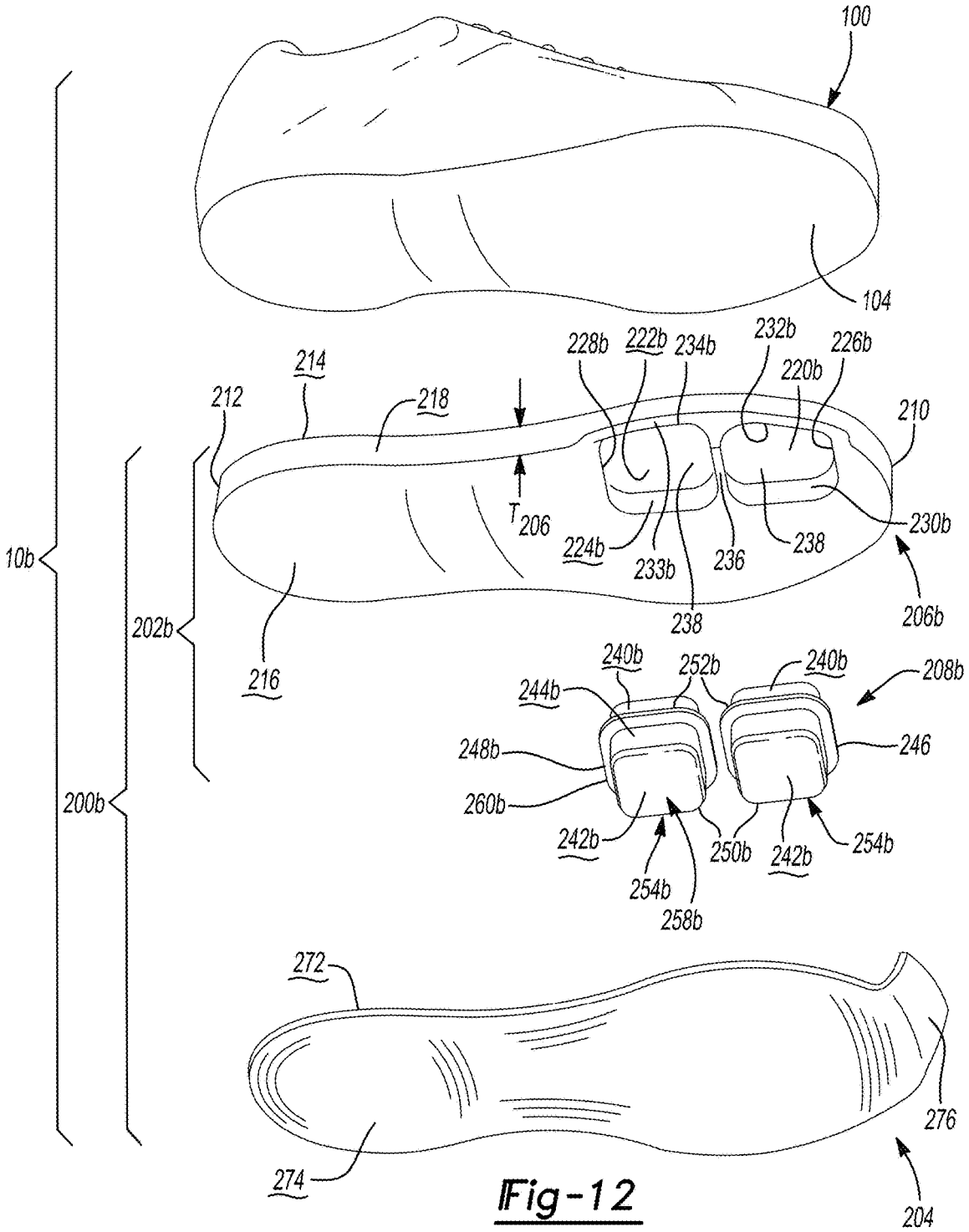
FIG. 12 is an exploded view of the article of footwear of FIG. 11, showing the article of footwear having an upper and a sole structure arranged in a layered configuration.

With reference to FIG. 12, the sole structure 200*b* includes a midsole 202*b* configured to provide cushioning characteristics of the sole structure 200*b*, and the outsole 204 configured to provide the ground-engaging surface 30 of the article of footwear 10*b*. The midsole 202*b* is formed compositely and includes a plurality of subcomponents for providing zonal cushioning and performance characteristics to the sole structure 200*b*. For example, the midsole 202*b* includes a foam element 206*b* and a cushioning arrangement 208*b*, which cooperate to define a bottom surface of the midsole 202*b* for attaching the outsole 204. As described in greater detail below, the outsole 204 is attached to a bottom surface of the midsole 202*b* and forms the ground-engaging surface 30 of the footwear 10*b*. The foam element 206*b*, the cushioning arrangement 208*b*, and the outsole 204 may be assembled and secured to each other using various methods of bonding, including adhesively bonding and melding, for example.

As shown, the foam element 206*b* of FIG. 12 includes a recess 220*b* formed in the bottom surface 216. The recess 220*b* is defined by an intermediate surface 222*b* disposed between the top surface 214 and the bottom surface 216 and a peripheral wall 224*b* extending from the intermediate surface 222*b* to the bottom surface 216. Accordingly, a depth $D_{220b}$ of the recess 220*b* is defined by a distance from the bottom surface 216 to the intermediate surface 222*b*, while an outer profile of the recess 220*b* is defined by the peripheral wall 224*b*.

Figure 13:
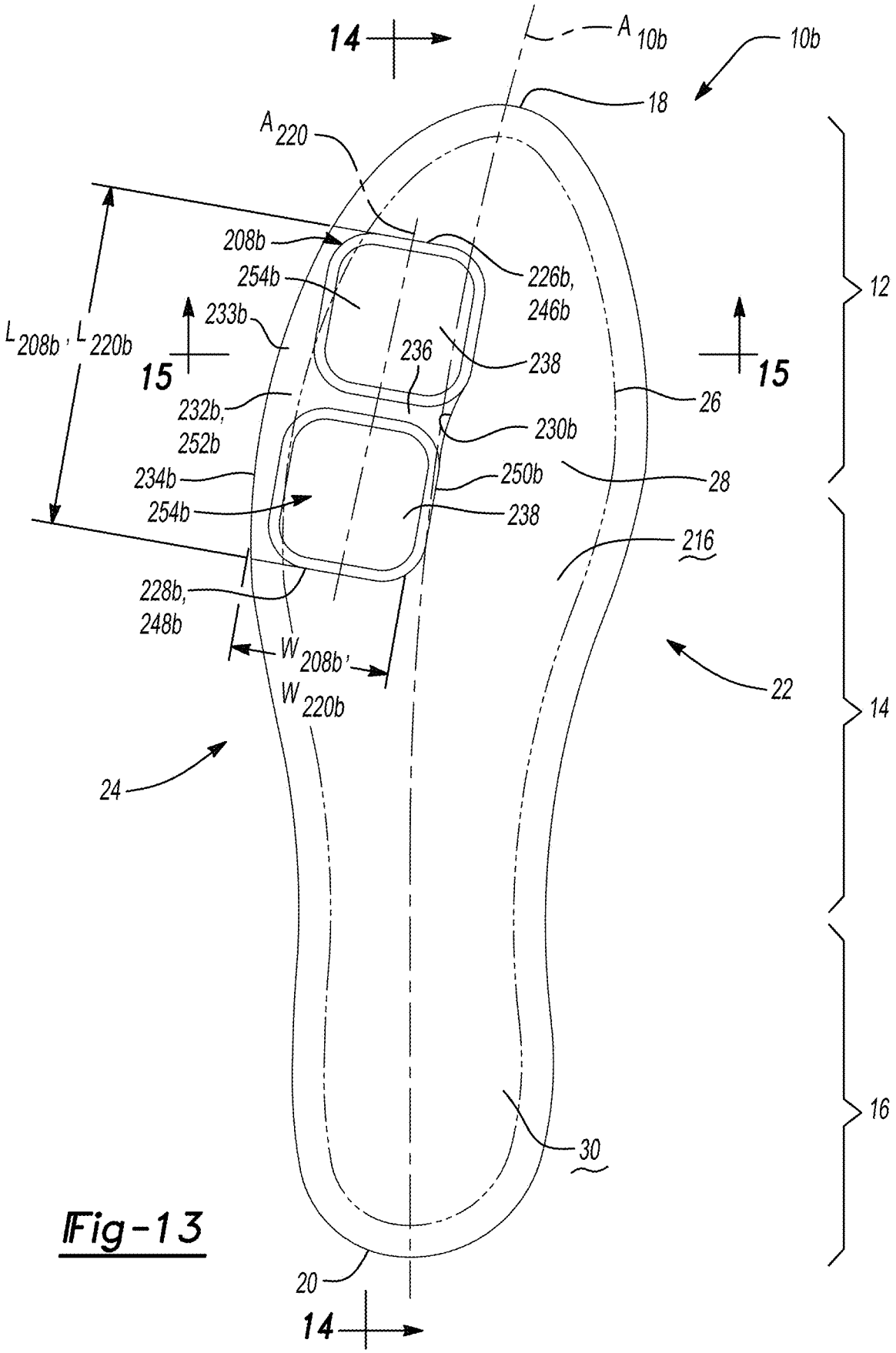
FIG. 13 is a bottom view of the sole structure of article of footwear of FIG. 11.
Figure 14:
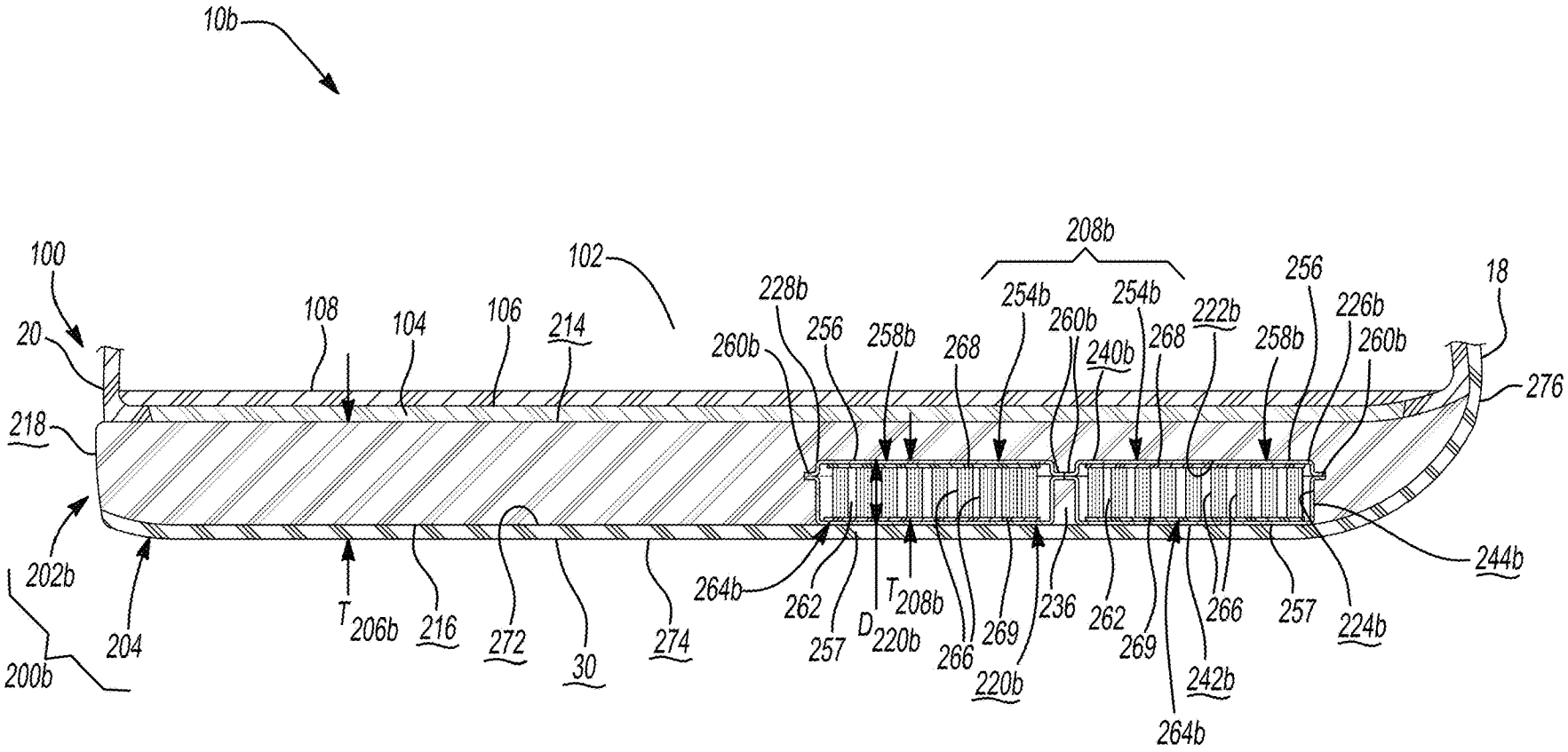
FIG. 14 is a cross-sectional view of the article of footwear of FIG. 11, taken along line 14-14 of FIG. 13 and corresponding to a longitudinal axis of the article of footwear.
Figure 15:
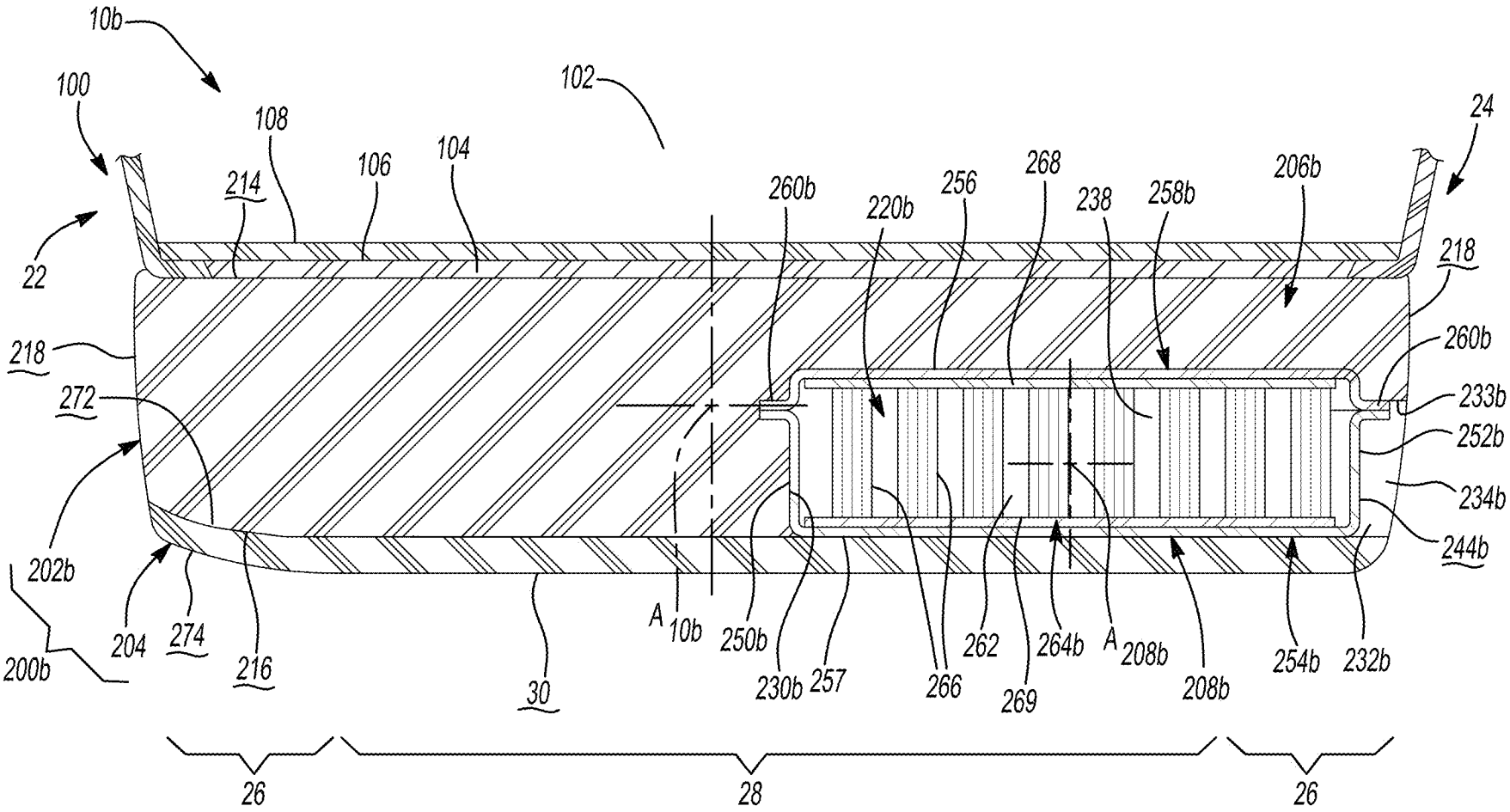
FIG. 15 is a cross-sectional view of the article of footwear of FIG. 11, taken along line 15-15 of FIG. 13 and corresponding to a forefoot region of the article of footwear.

The recess 220*b* extends along the length of the foam element 206*b* from a first end 226*b* in the forefoot region 12 to a second end 228*b* in the mid-foot region 14. The recess 220*b* further includes an inner side 230*b* and an outer side 232*b* formed on an opposite side of the recess 220*b* from the inner side 230*b*. The inner side 230*b* and the outer side 232*b* extend from the first end 226*b* to the second end 228*b*, whereby a distance from the first end 226*b* to the second end 228*b* defines a length $L_{220b}$ of the recess 220*b* and a distance from the inner side 230*b* to the outer side 232*b* defines a width $W_{220b}$ of the recess 220*b*. As shown in FIG. 13, a longitudinal axis $A_{220b}$ of the recess 220*b* extends from the first end 226*b* to the second end 228*b*, and is centrally located between the inner side 230*b* and the outer side 232*b* of the recess 220*b*.

Generally, the recess 220*b* is laterally offset relative to the longitudinal axis $A_{10b}$ of the footwear 10*b*, whereby the longitudinal axis $A_{220b}$ of the recess 220*b* is spaced apart from and extends along the same direction as the longitudinal axis $A_{10b}$ of the footwear 10*b*. Put another way, a distance that the inner side 230*b* is spaced apart from the peripheral side surface 218 is greater than a distance that the outer side 232*b* is spaced apart from the peripheral side surface 218. In some examples, the inner side 230*b* of the recess 220*b* is formed in the interior region 28 of the sole structure 200*b*, while the outer side 232*b* is formed in the peripheral region 26 of the sole structure 200*b*.

In a particular example, the recess 220*b* is offset towards the lateral side 24 of the sole structure 200*b* such that the outer side 232*b* is formed proximate to the peripheral side surface 218 along the lateral side 24, and the inner side 230*b* is spaced apart from the peripheral side surface 218 on the medial side 22. As shown, a portion of the peripheral wall 224*b* defining the outer side 232*b* of the recess 220*b* may extend only partially from the intermediate surface 222*b* to the bottom surface 216, whereby a terminal end 233*b* of the peripheral wall 224*b* defines an opening 234*b* that extends through the peripheral side surface 218 of the foam element 206*b*. Conversely, a portion of the peripheral wall 224*b* defining the inner side 230*b* extends completely from the intermediate surface 222*b* to the bottom surface 216 to fully enclose the recess 220*b* along the medial side 22. In some examples, the outer side 232*b* is formed in the peripheral region 26 on the lateral side 24, while the inner side 230*b* is formed in the interior region 28. In some examples, the inner side 230*b* of the recess 220*b* may be formed proximate to the longitudinal axis $A_F$ of the footwear 10.

As shown in FIG. 13, the bottom surface 216 of the foam element 206*b* extends from the inner side 230*b* of the recess 220*b* to the peripheral side surface 218 along the recess 220*b* from the first end 226*b* of the recess 220*b* to the second end 228*b* of the recess 220*b*. Accordingly, the sole structure 200*b* is configured to provide zonal cushioning properties through the forefoot region 12 and the mid-foot region 14, whereby the cushioning arrangement 208*b* defines cushioning properties of the sole structure 200*b* on the lateral side 24 in the forefoot region 12 and the mid-foot region 14, while the foam element 206*b* defines the cushioning properties of the sole structure 200*b* along the medial side 22 of the forefoot region 12 and the mid-foot region 14.

As discussed in greater detail below, the peripheral wall 224*b* of the recess 220*b* is configured to cooperate with an outer peripheral profile of the cushioning arrangement 208*b*, whereby the cushioning arrangement 208*b* substantially fills the recess 220*b*. Accordingly, the profile of the peripheral wall 224*b* will correspond to the profile of the cushioning arrangement 208*b*. In the example shown in FIG. 12, the cushioning arrangement 208*b* is a fragmentary structure extending discontinuously from the first end 226*b* of the recess 220*b* to the second end 228*b* of the recess 220*b*. Here, the peripheral wall 224*b* defines one or more dividers 236 extending from the inner side 230*b* to the outer side 232*b* for subdividing the recess 220*b* into a plurality of individual receptacles 238.

Referring to FIG. 12, the cushioning arrangement 208*b* includes a top surface 240*b* and a bottom surface 242*b* formed on an opposite side of the cushioning arrangement 208*b* from the top surface 240*b* such that a distance from the top surface 240*b* to the bottom surface 242*b* defines a thickness $T_{208b}$ of the cushioning arrangement 208*b*. An outer peripheral surface 244*a* extends between the top surface 240*b* and the bottom surface 242*b* and defines the outer peripheral profile of the cushioning arrangement 208*b*.

As shown in FIG. 13, the thickness $T_{208b}$ of the cushioning arrangement 208*b* is substantially similar to the depth $D_{220b}$ of the recess 220*b* such that the bottom surface 242*b* of the cushioning arrangement 208*b* is flush with the bottom surface 216 of the foam element 206*b* when the top surface 240*b* of the cushioning arrangement 208*b* is interfaced with (i.e. contacts) the intermediate surface 222*b* of the recess 220*b*. Accordingly, the bottom surface 216 of the foam element 206*b* and the bottom surface 242*b* of the cushioning arrangement 208*b* cooperate to define a substantially continuous, load-bearing bottom surface of the midsole 202*b*.

The cushioning arrangement 208*b* extends from a first end 246*b* to second end 248*b* formed at an opposite end of the cushioning arrangement 208*b* from the first end 246*b*. The cushioning arrangement 208*b* further includes an inner side 250*b* and an outer side 252*b* formed on an opposite side of the cushioning arrangement 208*b* from the inner side 250*b*. The inner side 250*b* and the outer side 252*b* extend from the first end 246*b* to the second end 248*b*, whereby a distance from the first end 246*b* to the second end 248*b* defines a length $L_{208b}$ of the cushioning arrangement 208*b*, and a distance from the inner side 250*b* to the outer side 252*b* defines a width $W_{208b}$ of the cushioning arrangement 208*b*.

The length $L_{208b}$ and the width $W_{208b}$ of the cushioning arrangement 208*b* are substantially similar to the length $L_{220b}$ and the width $W_{220b}$ of the recess 220*b*. Similarly, profiles of the first end 246*b*, the second end 248*b*, the inner side 250*b*, and the outer side 252*b* of the cushioning arrangement 208*b*, which are defined by the peripheral surface 244*a*, correspond to profiles of the first end 226*b*, the second end 228*b*, the inner side 230*b*, and the outer side 232*b* of the recess 220*b*. Accordingly, when the cushioning arrangement 208*b* is disposed within the recess 220*b*, the outer peripheral surface 244*a* of the cushioning arrangement 208*b* is received by and contacts the peripheral wall 224*b* of the recess 220*b*, such that the cushioning arrangement 208*b* substantially fills the recess 220*b*. Accordingly, the cushioning arrangement 208*b* is inherently arranged in the same position as the recess 220*b*.

Figure 11:
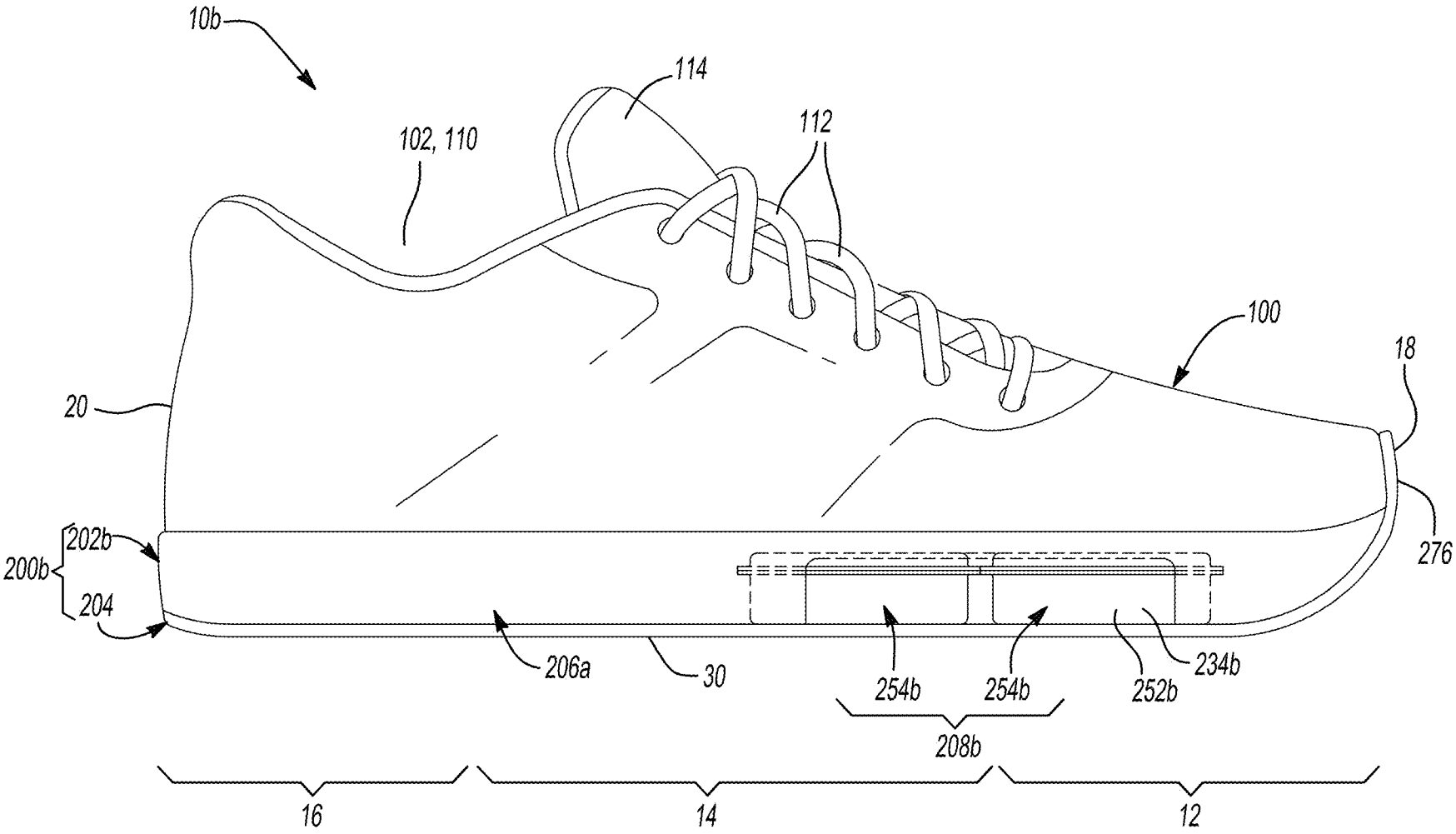
FIG. 11 is a side elevation view of an article of footwear in accordance with principles of the present disclosure.

As discussed above, the portion of the peripheral wall 224*b* forming the outer side 232*b* of the recess 220*b* extends partially from the intermediate surface 222*b* to the bottom surface 216, whereby the opening 234*b* extends from the peripheral side surface 218 to the recess 220*b*. Accordingly, the outer side 252*b* of the cushioning arrangement 208*b* may be exposed through the opening 234*b*, as shown in FIG. 11. In some examples, the outer side 252*b* of the cushioning arrangement 208*b* is recessed inwardly from the peripheral side surface 218. Alternatively, the outer side 252*b* of the cushioning arrangement 208*b* may extend at least partially through the opening 234*b*, whereby the outer side 252*b* of the cushioning arrangement 208*b* cooperates with the peripheral side surface 218 to form a substantially continuous outer surface of the sole structure 200*b*.

As discussed above with respect to the recess 220*b*, the cushioning arrangement 208*b* may be formed as a fragmentary structure including a plurality of bladders 254*b* positioned along the lateral side 24 of the sole structure 200 from the forefoot region 12 to the mid-foot region 14. However, regardless of the composition (i.e. unitary, fragmentary) of the cushioning arrangement 208*b*, the characteristics described above with respect to the construction and position of the cushioning arrangement 208 are maintained, whereby the cushioning arrangement 208*b* is offset from the longitudinal axis $A_{10b}$ of the footwear 10*b*. Particularly, the outer side 252*b* of the cushioning arrangement 208*b* is proximate the lateral side 24 of the sole structure 200*b*, while the inner side 250*b* is disposed within the interior region 28 of the sole structure 200*b*.

Where the cushioning arrangement 208*b* is formed as a fragmentary structure, two or more bladders 254*b* may be aligned along the longitudinal axis $A_{208b}$ of the cushioning arrangement 208*b* from the first end 246*b* to the second end 248*b* with the inner side 250*b* and the outer side 252*b* of the cushioning arrangement 208*b* being defined in a collective manner by respective inner and outer sides of the individual bladders 254*b*. In the illustrated example, the cushioning arrangement 208*b* includes a pair of the bladders 254*b*. A first one of the bladders 254*b* is disposed adjacent to the first end 226*b* of the recess 220*b* in the forefoot region 12, and a second one of the bladders 254*b* is disposed adjacent to the second end 228*b* of the recess 220*b* in the mid-foot region 14. As discussed above, the bladders 254*b* may be at least partially separated by a divider 236 extending from the intermediate surface 222*b* of the recess 220*b*, whereby each bladder 254*b* is received within one of the receptacles 238.

Referring now to FIGS. 16-20, an article of footwear 10*c* is provided and includes an upper 100 and a sole structure 200*c* attached to the upper 100. In view of the substantial similarity in structure and function of the components associated with the article of footwear 10 with respect to the article of footwear 10*c*, like reference numerals are used hereinafter and in the drawings to identify like components, while like reference numerals containing letter extensions are used to identify those components that have been modified.

Figure 17:
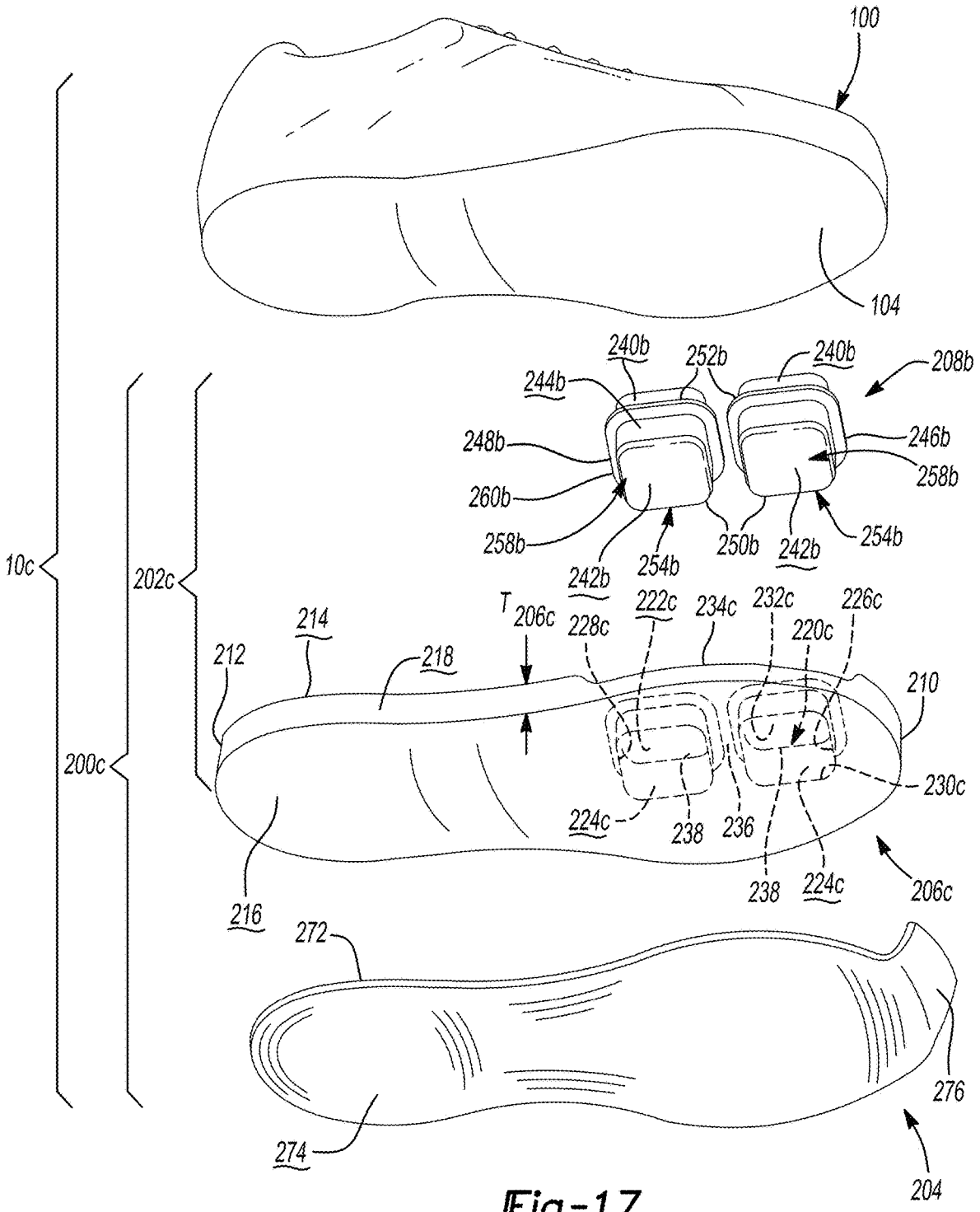
FIG. 17 is an exploded view of the article of footwear of FIG. 16, showing the article of footwear having an upper and a sole structure arranged in a layered configuration.

With reference to FIG. 17, the sole structure 200*c* includes a midsole 202*c* configured to provide cushioning characteristics of the sole structure 200*c*, and an outsole 204 configured to provide a ground-engaging surface 30 of the article of footwear 10*c*. The midsole 202*c* is formed compositely and includes a plurality of subcomponents for providing zonal cushioning and performance characteristics to the sole structure 200*c*. For example, the midsole 202*c* includes a foam element 206*c* and the cushioning arrangement 208*b*, which cooperate to define a top surface 214 of the midsole 202*c*. As described in greater detail below, the outsole 204 is attached to a bottom surface 216 of the midsole 202*c* and forms the ground-engaging surface 30 of the footwear 10*c*. The foam element 206*c*, the cushioning arrangement 208*b*, and the outsole 204 may be assembled and secured to each other using various methods of bonding, including adhesively bonding and melding, for example.

As shown, the foam element 206*c* of FIG. 17 includes a recess 220*c* formed in the top surface 214. The recess 220*c* is defined by an intermediate surface 222*c* disposed between the top surface 214 and the bottom surface 216 and a peripheral wall 224*c* extending from the intermediate surface 222*c* to the top surface 214. Accordingly, a depth $D_{220c}$ of the recess 220*c* is defined by a distance from the top surface 214 to the intermediate surface 222*c*, while an outer profile of the recess 220*c* is defined by the peripheral wall 224*c*.

Figure 18:
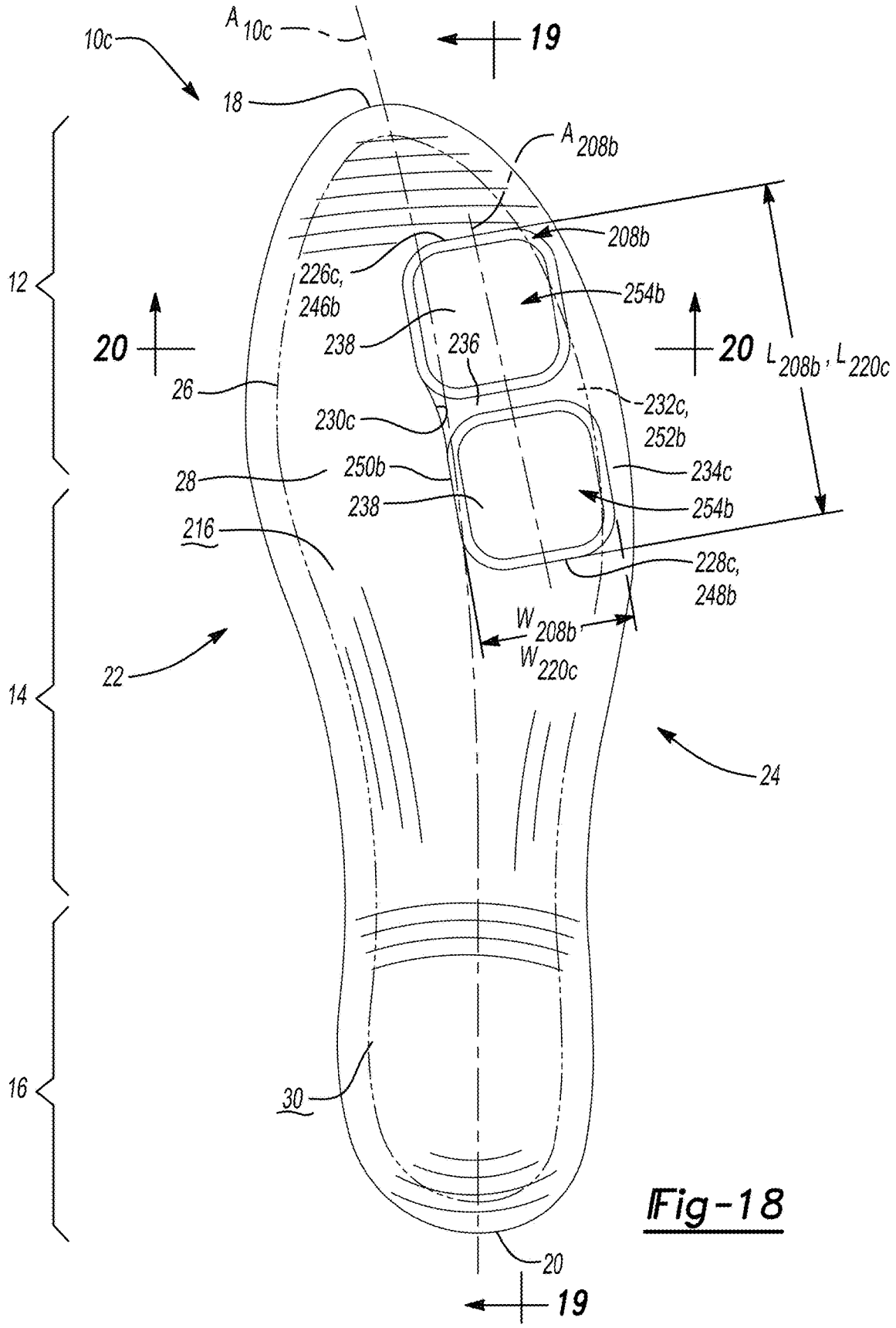
FIG. 18 is a top view of the sole structure of the article of footwear of FIG. 16.
Figure 19:
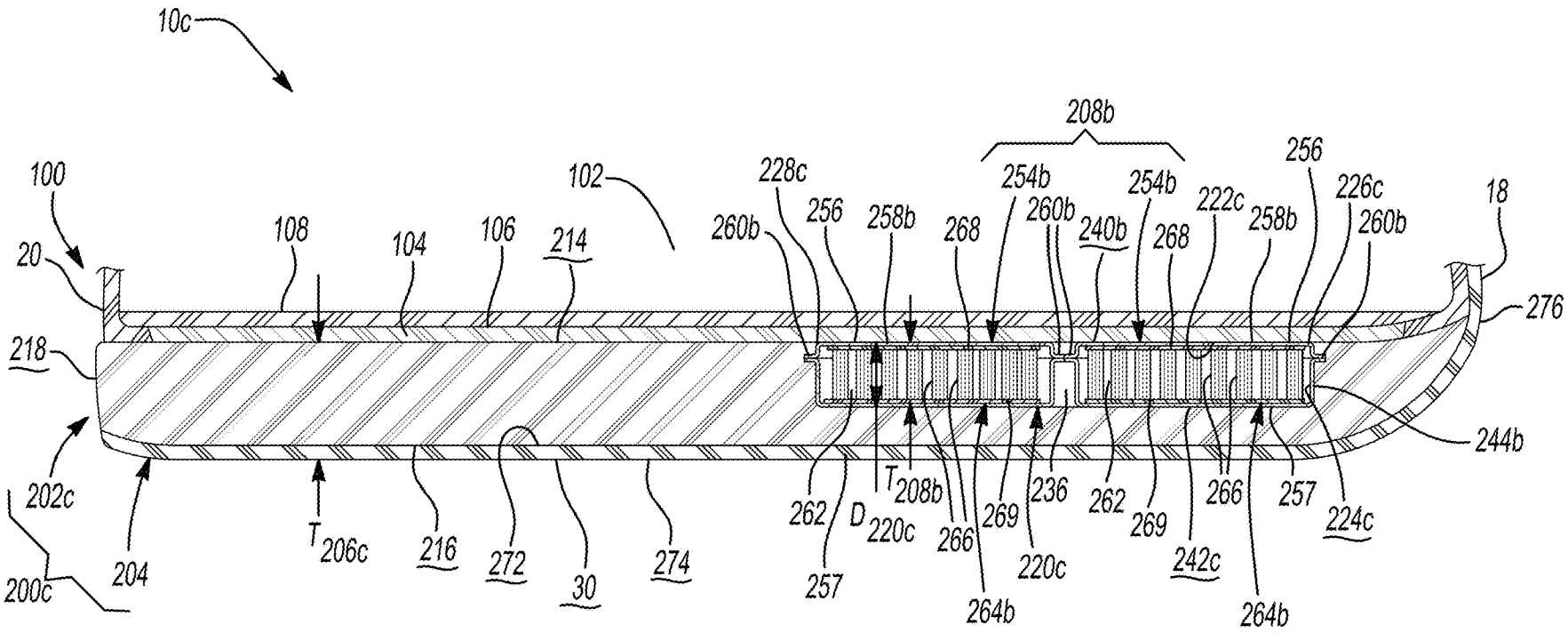
FIG. 19 is a cross-sectional view of the article of footwear of FIG. 16, taken along line 19-19 of FIG. 18 and corresponding to a longitudinal axis of the article of footwear.
Figure 20:
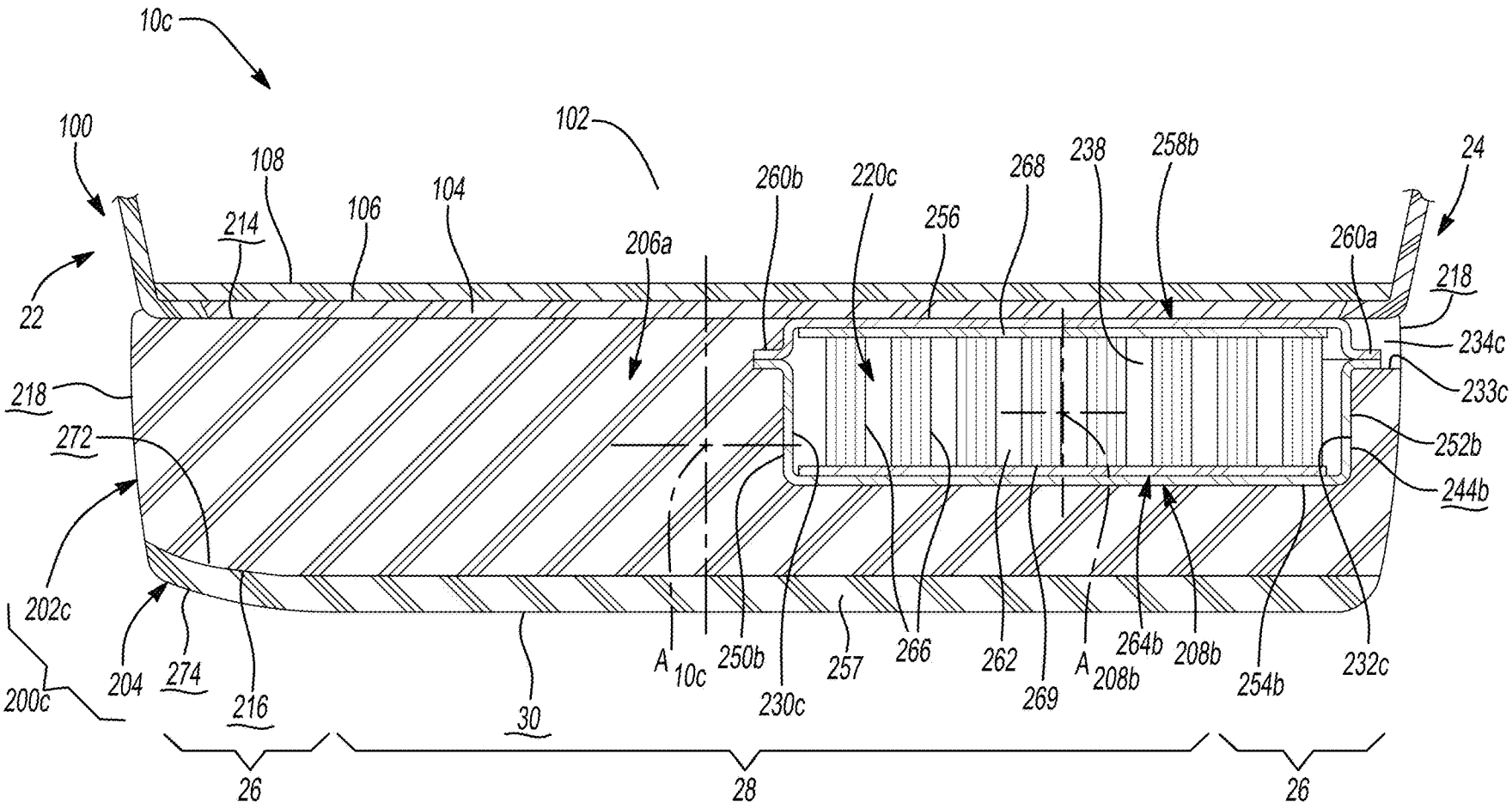
FIG. 20 is a cross-sectional view of the article of footwear of FIG. 16, taken along line 20-20 of FIG. 18 and corresponding to a forefoot region of the article of footwear.

The recess 220*c* extends along the length of the foam element 206*c* from a first end 226*b* in the forefoot region 12 to a second end 228*b* in the mid-foot region 14. The recess 220*c* further includes an inner side 230*c* and an outer side 232*c* formed on an opposite side of the recess 220*c* from the inner side 230*c*. The inner side 230*c* and the outer side 232*c* extend from the first end 226*b* to the second end 228*b* such that a distance from the first end 226*b* to the second end 228*b* defines a length $L_{220c}$ of the recess 220*c* and a distance from the inner side 230*c* to the outer side 232*c* defines a width $W_{220c}$ of the recess 220*c*. As shown in FIG. 18, a longitudinal axis $A_{220c}$ of the recess 220*c* extends from the first end 226*b* to the second end 228*b*, and is centrally located between the inner side 230*c* and the outer side 232*c* of the recess 220*c*.

Generally, the recess 220*c* is laterally offset relative to the longitudinal axis $A_{10c}$ of the footwear 10*c*, whereby the longitudinal axis $A_{220c}$ of the recess 220*c* is spaced apart from and extends along the same direction as the longitudinal axis $A_{10c}$ of the footwear 10*c*. Put another way, a distance that the inner side 230*c* is spaced apart from the peripheral side surface 218 is greater than a distance that the outer side 232*c* is spaced apart from the peripheral side surface 218. In some examples, the inner side 230*c* of the recess 220*c* is formed in the interior region 28 of the sole structure 200*c*, while the outer side 232*c* is formed in the peripheral region 26 of the sole structure 200*c*.

In a particular example, the recess 220*c* is offset towards the lateral side 24 of the sole structure 200*c*, whereby the outer side 232*c* is formed proximate to the peripheral side surface 218 along the lateral side 24, and the inner side 230*c* is spaced apart from the peripheral side surface 218 on the medial side 22. As shown, a portion of the peripheral wall 224*c* defining the outer side 232*c* of the recess 220*c* may extend only partially from the intermediate surface 222*c* to the top surface 214 with a terminal end 233*c* of the peripheral wall 224*c* defining an opening 234*c* that extends through the peripheral side surface 218 of the foam element 206*c*. Conversely, a portion of the peripheral wall 224*c* defining the inner side 230*c* extends completely from the intermediate surface 222*c* to the top surface 214 to fully enclose the recess 220*c* along the medial side 22. In some examples, the outer side 232*c* is formed in the peripheral region 26 on the lateral side 24, while the inner side 230*c* is formed in the interior region 28. In some examples, the inner side 230*c* of the recess 220*c* may be formed proximate to the longitudinal axis $A_F$ of the footwear 10.

As shown in FIG. 18, the top surface 214 of the foam element 206*c* extends from the inner side 230*c* of the recess 220*c* to the peripheral side surface 218 along the recess 220*c* from the first end 226*b* of the recess 220*c* to the second end 228*b* of the recess 220*c*. Accordingly, the sole structure 200*c* is configured to provide zonal cushioning properties through the forefoot region 12 and the mid-foot region 14, whereby the cushioning arrangement 208*b* defines cushioning properties of the sole structure 200*c* on the lateral side 24 in the forefoot region 12 and the mid-foot region 14, while the foam element 206*c* defines the cushioning properties of the sole structure 200*c* along the medial side 22 of the forefoot region 12 and the mid-foot region 14.

As discussed in greater detail below, the peripheral wall 224*c* of the recess 220*c* is configured to cooperate with an outer peripheral profile of the cushioning arrangement 208*b* such that the cushioning arrangement 208*b* substantially fills the recess 220*c*. Accordingly, the profile of the peripheral wall 224*c* will correspond to the profile of the cushioning arrangement 208*b*. In the example shown in FIG. 17, the cushioning arrangement 208*b* is a fragmentary structure extending discontinuously from the first end 226*b* of the recess 220*c* to the second end 228*b* of the recess 220*c*. Here, the peripheral wall 224*c* defines one or more dividers 236 extending from the inner side 230*c* to the outer side 232*c* for subdividing the recess 220*c* into a plurality of individual receptacles 238.

Referring to FIG. 17, the cushioning arrangement 208*b* includes a top surface 240*b* and a bottom surface 242*b* formed on an opposite side of the cushioning arrangement 208*b* from the top surface 240*b* such that a distance from the top surface 240*b* to the bottom surface 242*b* defines a thickness $T_{208b}$ of the cushioning arrangement 208*b*. An outer peripheral surface 244*a* extends between the top surface 240*b* and the bottom surface 242*b* and defines the outer peripheral profile of the cushioning arrangement 208*b*.

As shown in FIG. 18, the thickness $T_{208b}$ of the cushioning arrangement 208*b* is substantially similar to the depth $D_{220c}$ of the recess 220*c* such that the top surface 240*b* of the cushioning arrangement 208*b* is flush with the top surface 214 of the foam element 206*c* when the bottom surface 242*b* of the cushioning arrangement 208*b* is interfaced with (i.e. contacts) the intermediate surface 222*c* of the recess 220*c*. Accordingly, the top surface 214 of the foam element 206*c* and the top surface 240*b* of the cushioning arrangement 208*b* cooperate to define a substantially continuous, load-bearing top surface of the midsole 202*c*.

The cushioning arrangement 208*b* extends from a first end 246*b* to second end 248*b* formed at an opposite end of the cushioning arrangement from the first end 246*b*. The cushioning arrangement 208*b* further includes an inner side 250*b* and an outer side 252*b* formed on an opposite side of the cushioning arrangement 208*b* from the inner side 250*b*. The inner side 250*b* and the outer side 252*b* extend from the first end 246*b* to the second end 248*b*, whereby a distance from the first end 246*b* to the second end 248*b* defines a length $L_{208b}$ of the cushioning arrangement 208*b*, and a distance from the inner side 250*b* to the outer side 252*b* defines a width $W_{208b}$ of the cushioning arrangement 208*b*.

The length $L_{208b}$ and the width $W_{208b}$ of the cushioning arrangement 208*b* are substantially similar to the length $L_{220c}$ and the width $W_{220c}$ of the recess 220*c*. Similarly, profiles of the first end 246*b*, the second end 248*b*, the inner side 250*b*, and the outer side 252*b* of the cushioning arrangement 208*b*, which are defined by the peripheral surface 244*a*, correspond to profiles of the first end 226*b*, the second end 228*b*, the inner side 230*c*, and the outer side 232*c* of the recess 220*c*. Accordingly, when the cushioning arrangement 208*b* is disposed within the recess 220*c*, the outer peripheral surface 244*a* of the cushioning arrangement 208*b* is received by and contacts the peripheral wall 224*c* of the recess 220*c*, such that the cushioning arrangement substantially fills the recess 220*c*. Accordingly, the cushioning arrangement 208*b* is inherently arranged in the same position as the recess 220*c*, as discussed above.

Figure 16:
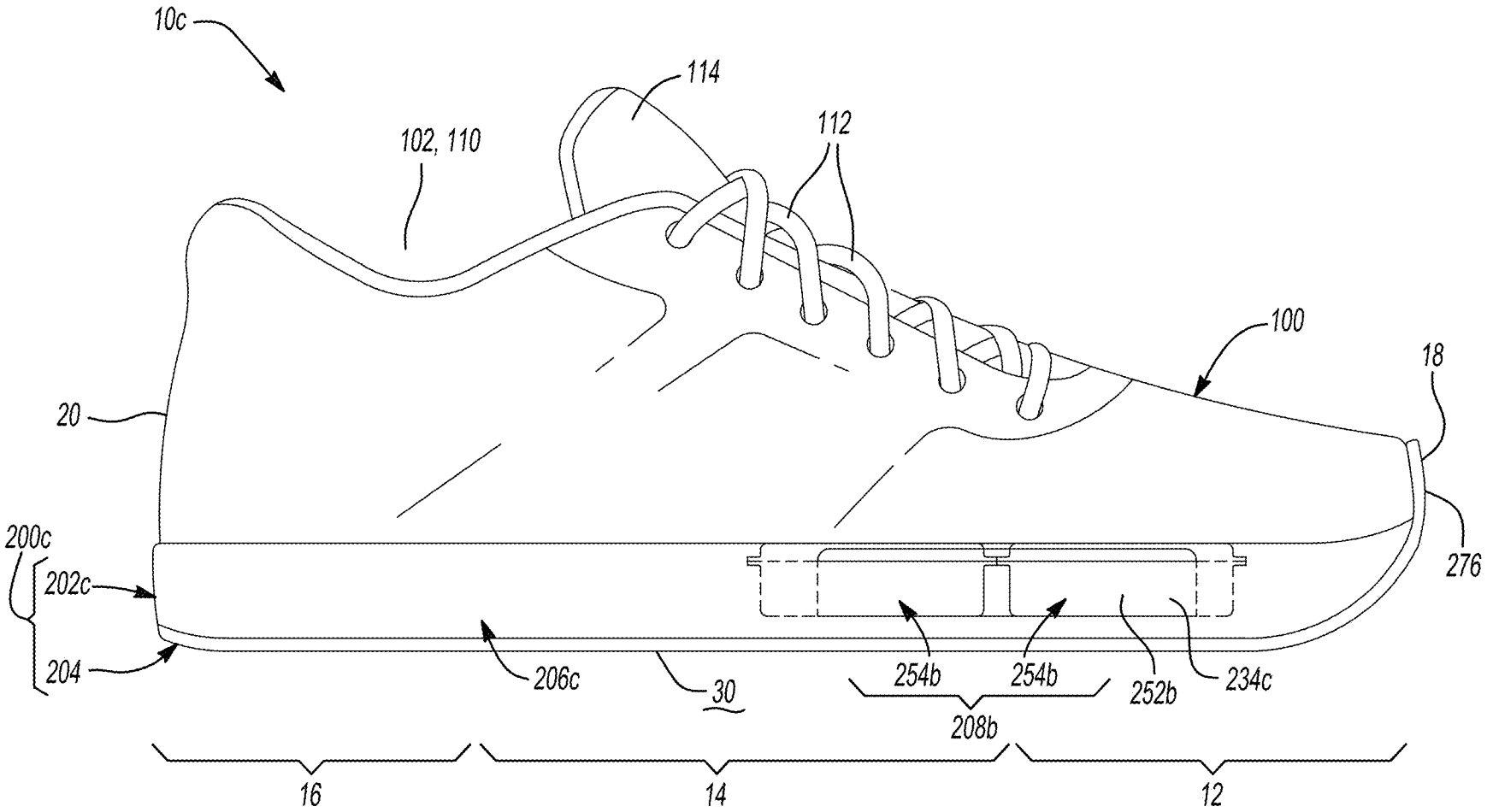
FIG. 16 is a side elevation view of an article of footwear in accordance with principles of the present disclosure.

As discussed above, the portion of the peripheral wall 224*c* forming the outer side 232*c* of the recess 220*c* extends partially from the intermediate surface 222*c* to the top surface 214, whereby the opening 234*c* extends from the peripheral side surface 218 to the recess 220*c*. Accordingly, the outer side 252*b* of the cushioning arrangement 208*b* may be exposed through the opening 234*c*, as shown in FIG. 16. In some examples, the outer side 252*b* of the cushioning arrangement 208*b* is recessed inwardly from the peripheral side surface 218. Alternatively, the outer side 252*b* of the cushioning arrangement 208*b* may extend at least partially through the opening 234*c*, whereby the outer side 252*b* of the cushioning arrangement 208*b* cooperates with the peripheral side surface 218 to form a substantially continuous outer surface of the sole structure 200*c*.

As discussed above with respect to the recess 220*c*, the cushioning arrangement 208*b* may be formed as a fragmentary structure including a plurality of individual bladders 254*b* positioned along the lateral side 24 of the sole structure from the forefoot region 12 to the mid-foot region 14. However, regardless of the composition (i.e. unitary, fragmentary) of the cushioning arrangement 208*b*, the characteristics described above with respect to the construction and position of the cushioning arrangement 208*b* are maintained, whereby the cushioning arrangement 208*b* is offset from the longitudinal axis $A_{10c}$ of the footwear 10*c*. Particularly, the outer side 252*b* of the cushioning arrangement 208*b* is proximate the lateral side 24 of the sole structure 200*c*, while the inner side 250*b* is disposed within the interior region 28 of the sole structure 200*c*.

Where the cushioning arrangement 208*b* is formed as a fragmentary structure, two or more bladders 254*b* may be aligned along the longitudinal axis $A_{208b}$ of the cushioning arrangement 208*b* from the first end 246*b* to the second end 248*b*, whereby the inner side 250*b* and the outer side 252*b* of the cushioning arrangement 208*b* are defined in a collective manner by respective inner and outer sides of the individual bladders 254*b*. In the illustrated example, the cushioning arrangement 208*b* includes a pair of the bladders 254*b*. A first one of the bladders 254*b* is disposed adjacent to the first end 226*b* of the recess 220*c* in the forefoot region 12, and a second one of the bladders 254*b* is disposed adjacent to the second end 228*b* of the recess 220*c* in the mid-foot region 14. As discussed above, the bladders 254*b* may be at least partially separated by a divider 236 extending from the intermediate surface 222*c* of the recess 220*c*, whereby each bladder 254*b* is received within one of the receptacles 238.

Regardless of whether the cushioning arrangement 208, 208*b* is formed as a unitary structure (208) or a fragmentary structure (208*b*), the bladders 254, 254*b* are constructed in a similar manner. For example, each of the bladders 254, 254*b* includes a first, upper barrier layer 256 and a second, lower barrier layer 257, which can be joined to each other at discrete locations to define a chamber 258, 258*b* and a peripheral seam 260, 260*b*. In some implementations, the upper barrier layer 256 and the lower barrier layer 257 cooperate to define a geometry (e.g., thicknesses, width, and lengths) of the chamber 258*a*. For example, the peripheral seam 260, 260*b* bounds the chamber 258*a* to seal the fluid (e.g., air) within the chamber 258, 258*b*. Thus, the chamber 258, 258*b* is associated with an area of the bladder 254, 254*b* where interior surfaces of the upper barrier layer 256 and the lower barrier layer 257 are not joined together and, thus, are separated from one another.

The upper and lower barrier layers 256, 257 are molded to correspond to a desired profile of the recess 220*a*-220*c*. In some implementations, the upper barrier layer 256 and the lower barrier layer 257 are formed by respective mold portions each defining various surfaces for forming depressions and pinched surfaces corresponding to locations where the peripheral seam 260, 260*b* is formed when the lower barrier layer 257 and the upper barrier layer 256 are joined and bonded together. In some implementations, adhesive bonding joins the upper barrier layer 256 and the lower barrier layer 257 to form the peripheral seam 260, 260*b*. In other implementations, the upper barrier layer 256 and the lower barrier layer 257 are joined to form the peripheral seam 260, 260*b* by thermal bonding. In some examples, one or both of the upper barrier layer 256 and the lower barrier layer 257 are heated to a temperature that facilitates shaping and melding. In some examples, the upper barrier layer 256 and the lower barrier layer 257 are heated prior to being located between their respective molds. In other examples, the mold may be heated to raise the temperature of the upper barrier layer 256 and the lower barrier layer 257. In some implementations, a molding process used to form the chamber 258, 258*b* incorporates vacuum ports within mold portions to remove air such that the upper barrier layer 256 and the lower barrier layer 257 are drawn into contact with respective mold portions. In other implementations, fluids such as air may be injected into areas between the upper barrier layer 256 and the lower barrier layer 257, such that pressure increases cause the upper barrier layer 256 and the lower barrier layer 257 to engage with surfaces of their respective mold portions.

As used herein, the term "barrier layer" (e.g., barrier layers 256, 257) encompasses both monolayer and multilayer films. In some embodiments, one or both of the barrier layers 256, 257 are each produced (e.g., thermoformed or blow molded) from a monolayer film (a single layer). In other embodiments, one or both of the barrier layers 256, 257 are each produced (e.g., thermoformed or blow molded) from a multilayer film (multiple sublayers). In either aspect, each layer or sublayer can have a film thickness ranging from about 0.2 micrometers to about be about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 256, 257 can independently be transparent, translucent, and/or opaque. As used herein, the term "transparent" for a barrier layer and/or a chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 256, 257 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 256, 257 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 256, 257 include two or more sublayers, examples of suitable multilayer films include microlayer films, such as those disclosed in Bonk et al., U.S. Pat. No. 6,582,786, which is incorporated by reference in its entirety. In further embodiments, barrier layers 256, 257 may each independently include alternating sublayers of one or more TPU copolymer materials and one or more EVOH copolymer materials, where the total number of sublayers in each of barrier layers 256 includes at least four (4) sublayers, at least ten (10) sublayers, at least twenty (20) sublayers, at least forty (40) sublayers, and/or at least sixty (60) sublayers.

The bladder 254, 254*b* can be produced from the barrier layers 256, 257 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 256, 257 can be produced by co-extrusion followed by vacuum thermoforming to produce an inflatable bladder 254, which can optionally include one or more valves (e.g., one way valves) that allows the chamber 258 to be filled with the fluid (e.g., gas).

As shown in the figures, a space formed between opposing interior surfaces of the upper barrier layer 256 and the lower barrier layer 257 defines an interior void 262 of the chamber 258, 258*b*. The interior void 262 of the chamber 258, 258*b* may receive a tensile element 264, 264*b* therein. Each tensile element 264, 264*b* may include a series of tensile strands 266 extending between an upper tensile sheet 268 and a lower tensile sheet 269. The upper tensile sheet 268 may be attached to the upper barrier layer 256 while the lower tensile sheet 269 may be attached to the lower barrier layer 257. In this manner, when the chamber 258, 258*b* receives the pressurized fluid, the tensile strands 266 of the tensile element 264, 264*b* are placed in tension. Because the upper tensile sheet 268 is attached to the upper barrier layer 256 and the lower tensile sheet 269 is attached to the lower barrier layer 257, the tensile strands 266 retain a desired shape of the cushioning arrangement 208, 208*b* when the pressurized fluid is injected into the interior void 262. For example, in the illustrated implementations, the tensile element 264, 264*b* maintains substantially planar top surface 240, 240*b* and bottom surface 242, 242*b* of the cushioning arrangement 208, 208*b*.

The chamber 258, 258*b* desirably has a low gas transmission rate to preserve its retained gas pressure. In some embodiments, the chamber 258, 258*b* has a gas transmission rate for nitrogen gas that is at least about ten (10) times lower than a nitrogen gas transmission rate for a butyl rubber layer of substantially the same dimensions. In an aspect, chamber 258, 258*b* has a nitrogen gas transmission rate of 15 cubic-centimeter/square-meter·atmosphere·day ($cm^3/m^2 \cdot atm \cdot day$) or less for an average film thickness of 500 micrometers (based on thicknesses of barrier layers 256). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

The chamber 258, 258*b* can be provided in a fluid-filled (e.g., as provided in footwear 10) or in an unfilled state. The chamber 258, 258*b* can be filled to include any suitable fluid, such as a gas or liquid. In other aspects, the chamber 258, 258*b* can alternatively include other media, such as pellets, beads, ground recycled material, and the like (e.g., foamed beads and/or rubber beads). As provided above, where a plurality of bladders 254*b* form the cushioning arrangement 208*b*, the interior voids 262 of each of the bladders 254*b* may be filled or pressurized differently from each other.

In an aspect, the gas can include air, nitrogen ($N_2$), or any other suitable gas. The fluid provided to the chamber 258, 258*b* can result in the chamber 258, 258*b* being pressurized. In some examples, the interior void 262 is at a pressure ranging from 15 psi (pounds per square inch) to 25 psi. In other examples, the interior void 262 may have a pressure ranging from 20 psi to 25 psi. In some examples, the interior void 262 has a pressure of 20 psi. In other examples, the interior void 262 has a pressure of 25 psi. Alternatively, the fluid provided to the chamber 258, 258*b* can be at atmospheric pressure such that the chamber 258, 258*b* is not pressurized but, rather, simply contains a volume of fluid at atmospheric pressure.

As described above, the foam elements 206-206*c* are formed of a resilient polymeric material, such as foam or rubber, to impart properties of cushioning, responsiveness, and energy distribution to the foot of the wearer. The foam elements 206-206*c* may be formed from a single unitary piece of resilient polymeric material, or may be formed of a plurality of elements each formed of one or more resilient polymeric materials. For example, the plurality of elements may be affixed to each other using a fusing process, using an adhesive, or by suspending the elements in a different resilient polymeric material. Alternatively, the plurality of elements may not be affixed to each other, but may remain independent while contained in one or more structures forming the cushioning element. In this alternative example, the plurality of independent cushioning elements may be a plurality of foamed particles, and may contained in a bladder or shell structure. As such, the foam elements 206-206*c* may be formed of a plurality of foamed particles contained within a relatively translucent bladder or shell formed of a film such as a barrier membrane.

Example resilient polymeric materials for the foam elements 206-206*c* may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., crosslinked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

The following Clauses provide an exemplary configuration for a sole structure for an article of footwear described above.

Clause 1. A sole structure for an article of footwear comprising a foam element having a top surface and a bottom surface formed on an opposite side of the foam element from the top surface. The foam element includes a recess (i) formed in the bottom surface, (ii) extending from a first end in a forefoot region of the sole structure to a second end in a mid-foot region of the sole structure, (iii) having a first edge extending between the first end and the second end and disposed proximate to a peripheral region of the sole structure, and (iv) having a second edge extending between the first end and the second end and disposed at an interior region of the sole structure. A cushioning arrangement is disposed within the recess and includes an outer surface that is substantially flush with the bottom surface of the foam element.

Clause 2. The sole structure of Clause 1, wherein the cushioning arrangement is a bladder that is matingly received by the recess.

Clause 3. The sole structure of Clause 2, wherein the bladder includes a tensile member disposed therein.

Clause 4. The sole structure of Clause 1, wherein the cushioning arrangement includes a bladder extending continuously from the first end of the recess to the second end of the recess.

Clause 5. The sole structure of Clause 4, wherein the first end of the recess is curved and the second end of the recess is substantially straight.

Clause 6. The sole structure of Clause 1, wherein the cushioning arrangement includes a first bladder disposed adjacent to the first end of the recess and a second bladder disposed adjacent to the second end of the recess.

Clause 7. The sole structure of Clause 1, wherein the first edge extends through a peripheral side surface of the foam element to form an opening in the peripheral side surface.

Clause 8. The sole structure of Clause 7, wherein the cushioning arrangement is exposed through the opening.

Clause 9. The sole structure of Clause 1, wherein the first edge is located at a lateral side of the sole structure.

Clause 10. The sole structure of Clause 1, wherein the cushioning arrangement substantially fills the recess.

Clause 11. A sole structure for an article of footwear comprising a foam element extending from an anterior end of the sole structure to a posterior end of the sole structure along a first longitudinal axis and including a bottom surface having a recess. The recess extending (i) from a first end in a forefoot region of the sole structure to a second end in a mid-foot region of the sole structure and (ii) along a second longitudinal axis that is laterally offset towards a lateral side of the sole structure from the first longitudinal axis. A cushioning arrangement is disposed within and substantially fills the recess, an outer surface of the cushioning arrangement being substantially flush with the bottom surface of the foam element.

Clause 12. The sole structure of Clause 11, wherein the cushioning arrangement is a bladder that is matingly received by the recess.

Clause 13. The sole structure of Clause 12, wherein the bladder includes a tensile member disposed therein.

Clause 14. The sole structure of Clause 12, wherein the cushioning arrangement includes a bladder extending continuously from the first end of the recess to the second end of the recess.

Clause 15. The sole structure of Clause 14, wherein the first end of the recess is curved and the second end of the recess is substantially straight.

Clause 16. The sole structure of Clause 11, wherein the cushioning arrangement includes a first bladder disposed adjacent to the first end of the recess and a second bladder disposed adjacent to the second end of the recess.

Clause 17. The sole structure of Clause 11, wherein an outer edge of the recess extends through a peripheral side surface of the foam element to form an opening in the peripheral side surface.

Clause 18. The sole structure of Clause 17, wherein the cushioning arrangement is exposed through the opening.

Clause 19. The sole structure of Clause 18, wherein the opening is formed on the lateral side of the sole structure.

Clause 20. The sole structure of Clause 11, wherein the cushioning arrangement substantially fills the recess.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a foam element having a top surface, a bottom surface formed on an opposite side of the foam element from the top surface, and a peripheral side surface extending from the top surface to the bottom surface, the foam element including (i) a first recess formed in one of the top surface or the bottom surface and extending from a first end to a second end, (ii) a second recess formed in the one of the top surface or the bottom surface and extending from a third end to a fourth end, (iii) a first opening extending from the peripheral side surface to the first recess between the first end and the second end to expose the first recess along one of a medial side or a lateral side of the foam element, (iv) a second opening extending from the peripheral side surface to the second recess between the third end and the fourth end to expose the second recess along the one of the medial side or the lateral side of the foam element, and (v) a peripheral wall extending from the top surface to the bottom surface between the first end and the second end to enclose the first recess along the other of the medial side or the lateral side of the foam element and between the third end and the fourth end to enclose the second recess along the other of the medial side or the lateral side;

a first cushion disposed within the first recess and (i) exposed by the first opening through the peripheral side surface on the one of the medial side or the lateral side and (ii) enclosed by the peripheral wall on the other of the medial side or the lateral side; and a second cushion disposed within the second recess and (i) exposed by the second opening through the peripheral side surface on the one of the medial side or the lateral side and (ii) enclosed by the peripheral wall on the other of the medial side or the lateral side, the second cushion disposed closer to a heel region of the sole structure than the first cushion.

2. The sole structure of claim 1, wherein the foam element includes a wall that extends from the top surface and between the first cushion and the second cushion.

3. The sole structure of claim 1, wherein at least one of the first cushion and the second cushion is a fluid-filled bladder.

4. The sole structure of claim 3, wherein the fluid-filled bladder includes a tensile member disposed therein.

5. The sole structure of claim 1, wherein the first cushion extends continuously from the first end to the second end and the second cushion extends continuously from the third end to the fourth end.

6. The sole structure of claim 1, wherein the first cushion is aligned with the second cushion along a first axis.

7. The sole structure of claim 6, wherein the first axis is convergent with a central, longitudinal axis of the sole structure.

8. The sole structure of claim 1, wherein the first cushion and the second cushion include at least one of the same size and shape.

9. The sole structure of claim 1, wherein at least one of the first cushion and the second cushion is disposed in a forefoot region of the sole structure.

10. An article of footwear incorporating the sole structure of claim 1.

11. A sole structure for an article of footwear, the sole structure comprising:

a foam element having a top surface, a bottom surface formed on an opposite side of the foam element from the top surface, and a peripheral side surface extending from the top surface to the bottom surface, the foam element including (i) a first recess formed in one of the top surface or the bottom surface and extending from a first end to a second end, (ii) a second recess formed in the one of the top surface or the bottom surface and extending from a third end to a fourth end, (iii) a first opening extending from the peripheral side surface to the first recess between the first end and the second end to expose the first recess along one of a medial side or a lateral side of the foam element, (iv) a second opening extending from the peripheral side surface to the second recess between the third end and the fourth end to expose the second recess along the one of the medial side or the lateral side of the foam element, and (v) a peripheral wall extending from the top surface to the bottom surface between the first end and the second end to enclose the first recess along the other of the medial side or the lateral side of the foam element and between the third end and the fourth end to enclose the second recess along the other of the medial side or the lateral side;

a first cushion disposed within the first recess and (i) exposed by the first opening through the peripheral side surface on the one of the medial side or the lateral side and (ii) enclosed by the peripheral wall on the other of the medial side or the lateral side; and a second cushion disposed within the second recess and (i) exposed by the second opening through the peripheral side surface on the one of the medial side or the lateral side and (ii) enclosed by the peripheral wall on the other of the medial side or the lateral side, the second cushion spaced apart from the first cushion along a longitudinal axis of the sole structure.

12. The sole structure of claim 11, wherein the foam element includes a wall that extends from the top surface and between the first cushion and the second cushion.

13. The sole structure of claim 11, wherein at least one of the first cushion and the second cushion is a fluid-filled bladder.

14. The sole structure of claim 13, wherein the fluid-filled bladder includes a tensile member disposed therein.

15. The sole structure of claim 11, wherein the first cushion extends continuously from the first end to the second end and the second cushion extends continuously from the third end to the fourth end.

16. The sole structure of claim 11, wherein the first cushion is aligned with the second cushion along a first axis.

17. The sole structure of claim 16, wherein the first axis is convergent with a central, longitudinal axis of the sole structure.

18. The sole structure of claim 11, wherein the first cushion and the second cushion include at least one of the same size and shape.

19. The sole structure of claim 11, wherein at least one of the first cushion and the second cushion is disposed in a forefoot region of the sole structure.

20. An article of footwear incorporating the sole structure of claim 11.

* * * * *